US008869775B2

(12) United States Patent
Maruyama et al.

(10) Patent No.: US 8,869,775 B2
(45) Date of Patent: Oct. 28, 2014

(54) FUEL SUPPLY APPARATUS

(75) Inventors: Kouji Maruyama, Aichi-gun (JP); Shinji Noda, Ichinomiya (JP)

(73) Assignee: Denso Corporation, Kariya (JP)

( * ) Notice: Subject to any disclaimer, the term of this patent is extended or adjusted under 35 U.S.C. 154(b) by 604 days.

(21) Appl. No.: 13/013,021

(22) Filed: Jan. 25, 2011

(65) Prior Publication Data

US 2011/0192381 A1 Aug. 11, 2011

(30) Foreign Application Priority Data

Feb. 9, 2010 (JP) ..... 2010-26836
Feb. 9, 2010 (JP) ..... 2010-26837
Mar. 1, 2010 (JP) ..... 2010-44539

(51) Int. Cl.
*F02M 37/04* (2006.01)
*F02M 37/08* (2006.01)

(52) U.S. Cl.
CPC ..... *F02M 37/08* (2013.01); *F02M 2037/085* (2013.01); *F02M 2037/082* (2013.01)
USPC ..... 123/497; 123/509

(58) Field of Classification Search
CPC ..... F02M 37/08; F02M 37/10; F02M 37/103; F02M 37/106; F02M 37/0082; F02M 37/082; F02M 37/085; B60K 2015/0319
USPC ..... 123/497, 509, 41.31, 198 C, 198 E; 417/423.5, 423.8, 423.14, 423.15; 439/587; 257/792
See application file for complete search history.

(56) References Cited

U.S. PATENT DOCUMENTS 3,038,823 A * 6/1962 Currant et al. ..... 427/546
5,338,163 A * 8/1994 Frank et al. ..... 417/410.1
5,345,124 A * 9/1994 Lang ..... 310/51
5,454,697 A * 10/1995 Nakanishi ..... 417/423.3
5,631,445 A * 5/1997 Herster ..... 174/151
6,187,242 B1 * 2/2001 Onoda ..... 264/255

(Continued)

FOREIGN PATENT DOCUMENTS

JP 62035088 A * 2/1987 ..... F04C 15/00
JP H01-89704 U 6/1989

(Continued)

OTHER PUBLICATIONS

Japanese Office Action dated Feb. 21, 2012, issued in corresponding Japanese Application No. 2010-044539 with English Translation.

(Continued)

*Primary Examiner* — Mahmoud Gimie
*Assistant Examiner* — John Zaleskas
(74) *Attorney, Agent, or Firm* — Nixon & Vanderhye, P.C.

(57) ABSTRACT

A receiving portion of a heat releasing member made of metal holds a controller, which is installed to the receiving portion through an opening of the receiving portion. An embeddable portion of the heat releasing member is formed at least along a peripheral edge of the opening of the receiving portion and is embedded in a flange, which is made of resin and covers a hole of a fuel tank. A protective member made of resin may cover each connecting portion between a corresponding one of terminals of the controller and a corresponding one of conductive line members. A primer agent coating may be applied to the conductive line members.

17 Claims, 12 Drawing Sheets

(56) References Cited

U.S. PATENT DOCUMENTS

| | | | | |
|---|---|---|---|---|
| 6,257,215 | B1 * | 7/2001 | Kaminaga et al. | 123/647 |
| 6,355,598 | B1 | 3/2002 | Takeda et al. | |
| 6,784,761 | B2 | 8/2004 | Takeda et al. | |
| 7,040,298 | B2 * | 5/2006 | Nakamura et al. | 123/509 |
| 7,078,628 | B2 * | 7/2006 | Watanabe et al. | 174/256 |
| 7,086,493 | B2 * | 8/2006 | Knight | 180/274 |
| 7,314,040 | B2 * | 1/2008 | Yagi et al. | 123/509 |
| 2002/0031672 | A1 * | 3/2002 | Eguchi et al. | 428/447 |
| 2002/0054201 | A1 | 5/2002 | Takeda et al. | |
| 2002/0054814 | A1 * | 5/2002 | Honma et al. | 415/55.1 |
| 2004/0055783 | A1 * | 3/2004 | Masuda | 174/252 |
| 2004/0063360 | A1 * | 4/2004 | Kikuchi | 439/736 |
| 2004/0065144 | A1 | 4/2004 | Mitani et al. | |
| 2004/0188121 | A1 * | 9/2004 | Ricco et al. | 174/50 |
| 2004/0231730 | A1 * | 11/2004 | Nakamura et al. | 137/565.16 |
| 2005/0100461 | A1 * | 5/2005 | Izutani et al. | 417/423.8 |
| 2005/0265852 | A1 * | 12/2005 | Nakazawa | 417/63 |
| 2005/0281684 | A1 | 12/2005 | Kumagai et al. | |
| 2006/0032663 | A1 * | 2/2006 | Hosoya | 174/151 |
| 2006/0042378 | A1 * | 3/2006 | Tanaka et al. | 73/305 |
| 2006/0115370 | A1 * | 6/2006 | Milton | 417/572 |
| 2006/0162702 | A1 * | 7/2006 | Lahn et al. | 123/497 |
| 2006/0272150 | A1 * | 12/2006 | Eguchi et al. | 29/841 |
| 2007/0233360 | A1 * | 10/2007 | Hill et al. | 701/123 |
| 2007/0246022 | A1 * | 10/2007 | Hazama | 123/514 |
| 2007/0253845 | A1 * | 11/2007 | Suzuki | 417/423.8 |
| 2007/0284006 | A1 * | 12/2007 | Suzuki et al. | 137/565.01 |
| 2008/0011276 | A1 * | 1/2008 | Satoh et al. | 123/509 |
| 2008/0053412 | A1 | 3/2008 | Suzuki | |
| 2008/0069705 | A1 * | 3/2008 | Fujimoto | 417/313 |
| 2008/0085636 | A1 * | 4/2008 | Kurahashi | 439/620.01 |
| 2008/0115772 | A1 * | 5/2008 | Kuperus | 123/513 |
| 2008/0216904 | A1 | 9/2008 | Kanamaru et al. | |
| 2008/0295808 | A1 * | 12/2008 | Tateishi et al. | 123/497 |
| 2009/0024271 | A1 * | 1/2009 | Inoue | 701/29 |
| 2009/0031995 | A1 * | 2/2009 | Tateishi | 123/509 |
| 2009/0090330 | A1 * | 4/2009 | Tateishi et al. | 123/357 |
| 2009/0103268 | A1 * | 4/2009 | Bryan et al. | 361/711 |
| 2009/0183715 | A1 * | 7/2009 | Yamamoto et al. | 123/497 |
| 2009/0193873 | A1 * | 8/2009 | Nakamura et al. | 73/31.05 |
| 2009/0275678 | A1 * | 11/2009 | Kumazawa et al. | 523/523 |
| 2009/0293966 | A1 * | 12/2009 | Murakoshi et al. | 137/565.01 |
| 2010/0073470 | A1 * | 3/2010 | Takasaki | 348/76 |
| 2010/0192922 | A1 * | 8/2010 | Masuda | 123/509 |

FOREIGN PATENT DOCUMENTS

| | | | | |
|---|---|---|---|---|
| JP | H02-131350 | U | | 10/1990 |
| JP | H2-278856 | | | 11/1990 |
| JP | 03064661 | A | * | 3/1991 |
| JP | H03-064661 | | | 3/1991 |
| JP | H4-176194 | | | 6/1992 |
| JP | H05-87298 | U | | 11/1993 |
| JP | H06-155560 | | | 6/1994 |
| JP | H06-155561 | | | 6/1994 |
| JP | H8-339585 | | | 12/1996 |
| JP | H09-57964 | | | 3/1997 |
| JP | P2000-286367 | A | | 10/2000 |
| JP | P2002-195445 | A | | 7/2002 |
| JP | P2004-169565 | A | | 6/2004 |
| JP | P2004-289017 | A | | 10/2004 |
| JP | 3794879 | | | 4/2006 |
| JP | P2006-311324 | A | | 11/2006 |
| JP | 2006329079 | A | * | 12/2006 |
| JP | P2007-040427 | A | | 2/2007 |
| JP | P2007-187145 | A | | 7/2007 |
| JP | 2007303360 | A | * | 11/2007 |
| JP | P2007-311401 | A | | 11/2007 |
| JP | 2008031896 | A | * | 2/2008 |
| JP | P2008-031896 | A | | 2/2008 |
| JP | 4178354 | | | 9/2008 |
| JP | P2009-181861 | A | | 8/2009 |
| JP | P2009-243331 | A | | 10/2009 |
| JP | P2010-022814 | A | | 2/2010 |

OTHER PUBLICATIONS

Japanese Office Action dated Jan. 24, 2012, issued in corresponding Japanese Application No. 2010-026836 with English Translation.

Japanese Office Action dated Jan. 24, 2012, issued in corresponding Japanese Application No. 2010-026837 with English Translation.

* cited by examiner

FUEL SUPPLY APPARATUS

CROSS REFERENCE TO RELATED APPLICATION

This application is based on and incorporates herein by reference Japanese Patent Application No. 2010-26837 filed on Feb. 9, 2010, Japanese Patent Application No. 2010-26836 filed on Feb. 9, 2010 and Japanese Patent Application No. 2010-44539 filed on Mar. 1, 2010.

BACKGROUND OF THE INVENTION

1. Field of the Invention

The present invention relates to a fuel supply apparatus, which supplies fuel in an internal combustion engine.

2. Description of Related Art

Nowadays, various on-vehicle electric devices are installed in a vehicle. In order to improve a fuel consumption of an internal combustion engine of the vehicle, it is necessary to minimize the electric power consumption of these on-vehicle electric devices.

As an exemplary way of reducing the electric power consumption of such an on-vehicle electric device, there is known a controller, which is provided in a fuel supply control apparatus and controls an electric power supplied to an electric fuel pump that pumps fuel from a fuel tank to the internal combustion engine (see, for example, Japanese Patent No. 3794879B2 or Japanese Patent No. 4178354B2).

The controller strictly controls the electric power supplied to the fuel pump based on a required quantity of fuel, which is required by the internal combustion engine. In this way, a discharge quantity of fuel, which is discharged from the fuel pump, is controlled based on the required quantity of fuel, which is required by the internal combustion engine, thereby enabling a reduction in the electric power consumption of the fuel pump.

Japanese Patent No. 3794879B2 and Japanese Patent No. 4178354B2 teach an intank fuel supply apparatus, which includes the fuel pump placed in the inside of the fuel tank. The fuel supply apparatus includes the fuel pump and a cover member made of a resin material. The fuel pump is placed in the fuel tank as discussed above, and the cover member covers a hole, i.e., an opening of the fuel tank and supports the fuel pump. The controller is installed to the cover member.

When the controller is operated, the controller generates heat. Therefore, it is required to effectively release the heat generated at the controller. In the fuel supply apparatus of Japanese Patent No. 3794879B2, the cover member includes a casing, which receives the controller, and a heat releasing plate, which conducts the heat generated at the controller to a metal fuel pipe. The heat releasing plate is embedded in the cover member.

In the fuel supply apparatus of Japanese Patent No. 4178354B2, the cover member includes a casing, which receives the controller, and a cover, which closes an opening of the casing and radiates the heat generated from the controller. The cover is fixed to the casing with fixing means (e.g., screws) through a gasket. The gasket limits intrusion of water and dust into the inside of the casing, in which the controller is received.

In the fuel supply apparatus of Japanese Patent No. 3794879B2, the casing, which receives the controller, is formed in the cover member, and a resin cover plate is installed to the casing to close the opening of the casing. As discussed above, in the cover member, the casing has the opening, which opens upwardly, so that the cover plate, which protects the controller received in the casing, needs to be provided separately from the heat releasing member.

In the fuel supply apparatus of Japanese Patent No. 4178354B2, the heat releasing cover, which covers the opening of the casing, has an effective heat releasing capability. However, it is required to clamp the gasket between the casing and the heat releasing cover, and the fixing means is required to fix the heat releasing cover to the casing.

The cover member further includes an outside connector and an inside connector. The outside connector electrically connects between an external device and the controller. The external device may be an internal combustion engine controller, which is located at an outside of the fuel tank and outputs a command signal according to a required amount of fuel, which is required by the internal combustion engine. The outside connector includes a connector housing and electrically conductive line members. Specifically, the connector housing is formed integrally with the cover member that is made of the resin material. One end part of each conductive line member is exposed externally from the connector housing of the outside connector, and the other end part of the conductive line member is electrically connected to a corresponding terminal of the controller.

The inside connector electrically connects between the fuel pump and the controller. Similar to the outside connector, the inside connector includes a connector housing and electrically conductive line members. Specifically, the connector housing is formed integrally with the cover member that is made of the resin material. One end part of each conductive line member is exposed externally from the connector housing of the inside connector, and the other end part of the conductive line member is electrically connected to a corresponding terminal of the controller. The conductive line members of the outside connector and the conductive line members of the inside connector are embedded in the cover member.

When the controller is operated, heat is generated. The heat, which is generated at the controller, is conducted to the terminals of the controller and the resin material of the cover member located around the controller. Thereby, each of the terminals, the conductive line members and the resin material will be expanded by the heat depending on a thermal expansion coefficient thereof.

In general, the thermal expansion coefficient of the resin material is different from the thermal expansion coefficient of the electrically conductive metal material. Therefore, even when the resin material and the electrically conductive metal material are exposed to the same heat, an amount of thermal expansion of the resin material differs from an amount of thermal expansion of the electrically conductive metal material. Thus, when the cover member, the terminals and the conductive line members are thermally expanded, a stress is concentrated at a connecting portion between the terminal of the controller and the corresponding conductive line member. Depending on the amount of stress concentrated at the connecting portion, the electrical connection state between the terminal and the conductive line member may be deteriorated to cause a disconnection between the terminal and the conductive line member.

Also, when a gap is formed between, for example, the cover member and the conductive line members due to a difference in the expansion coefficient between the resin material of the cover member and the electrically conductive metal material of the conductive line members, water or moisture may possibly be conducted to the conductive line members and causes short circuiting between the electrically conductive line members. Also, in this state, when the electric voltage is applied to the conductive line members, galvanic corrosion may occur at the conductive line members, thereby deteriorating a reliability of the fuel supply apparatus.

SUMMARY OF THE INVENTION

The present invention addresses the above disadvantages. According to the present invention, there is provided a fuel supply apparatus that is adapted to supply fuel, which is received in a fuel tank, to a fuel consuming apparatus located at an outside of the fuel tank. The fuel supply apparatus includes a cover member, an electric fuel pump, a controller and a heat releasing member. The cover member covers a hole formed in the fuel tank. The cover member is made of a resin material. The electric fuel pump is placed in an inside of the fuel tank. The electric fuel pump draws the fuel received in the fuel tank and discharges the drawn fuel upon pressurizing the drawn fuel when an electric power is supplied to the electric fuel pump. The controller is installed to the cover member and controls the electric power, which is supplied to the electric fuel pump. The heat releasing member is adapted to release heat generated from the controller and is made of a metal material, which has a heat conductivity that is higher than a heat conductivity of the resin material of the cover member. The heat releasing member includes a receiving portion and an embeddable portion. The receiving portion holds the controller, which is installed to the receiving portion through an opening of the receiving portion and contacts an inner wall surface of the receiving portion. The embeddable portion is formed at least along a peripheral edge of the opening of the receiving portion and is embedded in the cover member. The opening of the receiving portion is closed with the cover member.

According to the present invention, there is also provided a fuel supply apparatus that is adapted to supply fuel, which is received in a fuel tank, to a fuel consuming apparatus located at an outside of the fuel tank. The fuel supply apparatus includes a cover member, an electric fuel pump, a controller, at least one first side conductive line member, at least one second side conductive line member and a protective member. The cover member covers a hole formed in the fuel tank. The cover member is made of a resin material. The electric fuel pump is placed in an inside of the fuel tank. The electric fuel pump draws the fuel received in the fuel tank and discharges the drawn fuel upon pressurizing the drawn fuel when an electric power is supplied to the electric fuel pump. The controller is installed to the cover member and includes at least one first side terminal, which is adapted to be electrically connected to an external device located at the outside of the fuel tank, and at least one second side terminal, which is electrically connected to the electric fuel pump. The controller receives a command signal from the external device through a corresponding one of the at least one first side terminal and supplies the electric power to the electric fuel pump through the at least one second side terminal based on the command signal received from the external device. Each of the at least one first side conductive line member is made of an electrically conductive metal material and is embedded in the cover member such that one end part of the first side conductive line member is electrically connected to a corresponding one of the at least one first side terminal, and the other end part of the first side conductive line member is exposed from the cover member and is adapted to be electrically connected to the external device. Each of the at least one second side conductive line member is made of an electrically conductive metal material and is embedded in the cover member such that one end part of the second side conductive line member is electrically connected to a corresponding one of the at least one second side terminal, and the other end part of the second side conductive line member is exposed from the cover member and is electrically connected to the electric fuel pump. The protective member is embedded in the cover member and is made of a resin material, which has a thermal expansion coefficient that is smaller than a thermal expansion coefficient of the resin material of the cover member. The protective member directly covers each connecting portion between the corresponding one of the at least one first side terminal and the corresponding one of the at least one first side conductive line member and each connecting portion between the corresponding one of the at least one second side terminal and the corresponding one of the at least one second side conductive line member.

According to the present invention, there is also provided a fuel supply apparatus that is adapted to supply fuel, which is received in a fuel tank, to a fuel consuming apparatus located at an outside of the fuel tank based on a signal received from an external device. The fuel supply apparatus includes an electric fuel pump, a control device, a plurality of conductive line members and a cover member. The electric fuel pump is placed in an inside of the fuel tank. The electric fuel pump draws the fuel received in the fuel tank and discharges the drawn fuel upon pressurizing the drawn fuel when an electric power is supplied to the electric fuel pump. The control device includes a controller, which controls the electric fuel pump based on the signal received from the external device. Each of the plurality of conductive line members projects from the control device and electrically connects between the controller and a corresponding one of the external device and the electric fuel pump. The cover member covers a hole formed in the fuel tank, wherein the control device and the plurality of conductive line members are embedded in and are held by the cover member such that at least a portion of the control device and at least a portion of each of the plurality of conductive line members are exposed from the cover member. An expansion coefficient of a holding portion of the control device, which contacts the cover member and is held by the cover member, is different from an expansion coefficient of the cover member. A primer agent is applied to at least one of a root part of each of the plurality of the conductive line members and at least a section of the holding portion. The root part of each of the plurality of conductive line members is located adjacent to the control device. In the case where the primer agent is applied to the root part of each of the plurality of the conductive line members, the primer agent surrounds the root part and contacts the holding portion of the control device and the cover member. In the case where the primer agent is applied to at least the section of the holding portion, the primer agent surrounds at least the section of the holding portion and is placed between the holding portion of the control device and the cover member.

Furthermore, it should be noted that any one or more of the above limitations of any one or more of the above-described three fuel supply apparatuses may be combined with any one or more of the above limitations of another one or more of the above-described three fuel supply apparatuses to implement a desired fuel supply apparatus. For instance, the primer agent of the last fuel supply apparatus may be provided to any one of the other two fuel supply apparatuses. Also, the heat releasing member of the fuel supply apparatus described first may be provided to any one of the other two fuel supply apparatuses.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

Figure 1:
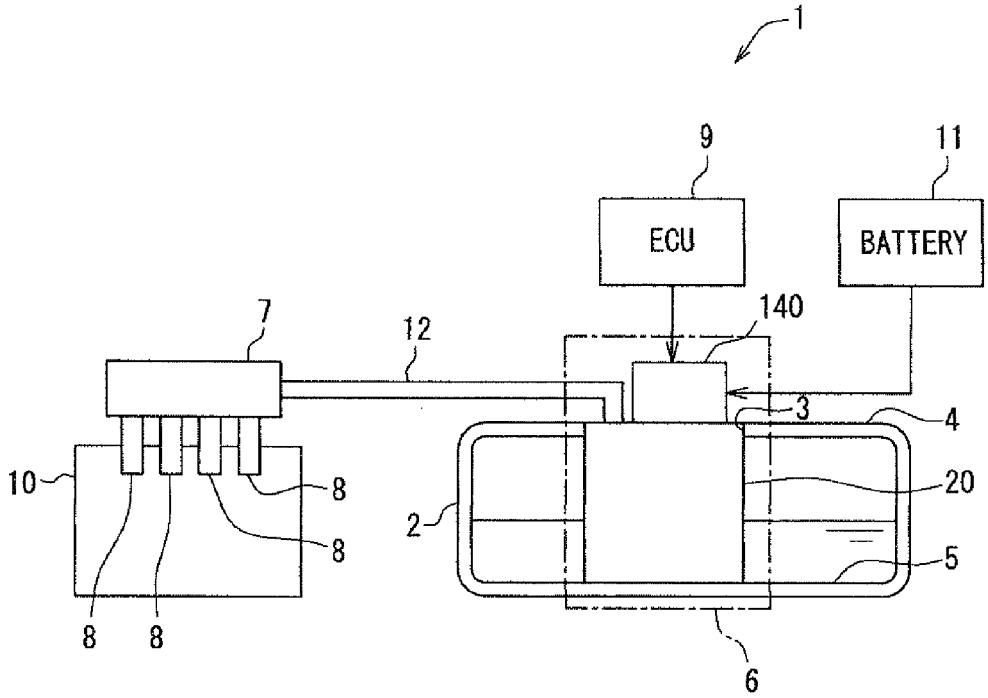
FIG. 1 is a schematic diagram showing a fuel supply system having a fuel supply apparatus according to a first embodiment of the present invention.

An embodiment of the present invention will be described with reference to the accompanying drawings. FIG. 1 is a schematic diagram showing a fuel supply system 1, which includes a fuel supply apparatus 6. The fuel supply system 1 is a system that supplies fuel, which is received in a fuel tank 2, to an internal combustion engine 10 (serving as a fuel consuming apparatus).

The fuel supply system 1 includes the fuel tank 2, the fuel supply apparatus 6, a delivery pipe 7, fuel injection valves 8 and an electronic control unit (ECU) 9. The fuel supply apparatus 6 draws the fuel in the fuel tank 2 and discharges the drawn fuel toward the delivery pipe 7 upon pressurizing the same. The fuel injection valves 8, which supply the fuel to the cylinders (not shown) of the internal combustion engine 10, are connected to the delivery pipe 7. In the present embodiment, the internal combustion engine 10 has four cylinders, and the fuel injection valves 8 are provided to intake ports (not shown), respectively, which are connected to the cylinders, respectively.

In the present embodiment, the fuel supply system 1 is implemented as a port injection type fuel supply system. Alternatively, the fuel supply system 1 may be implemented as a direct injection type fuel supply system where the fuel, which is injected from the fuel injection valve, is directly supplied in the corresponding cylinder.

The fuel supply apparatus 6 includes a pump module 20 and a control device 140. The control device 140 includes a fuel pump controller (FPC) 40, which controls the pump module 20. The pump module 20 draws the fuel in the fuel tank 2 and discharges the drawn fuel upon pressurizing the drawn fuel.

Figure 2:
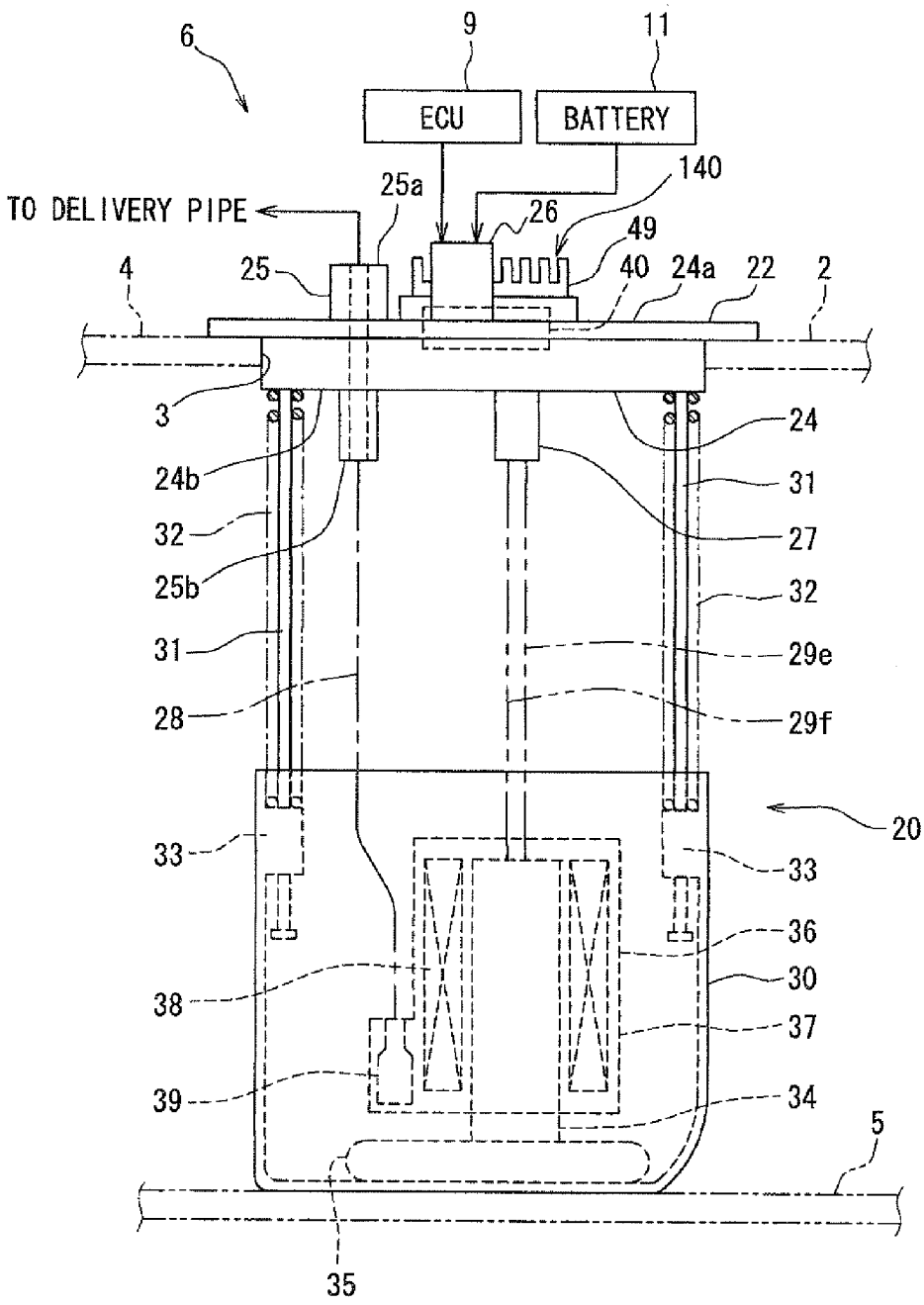
FIG. 2 is a schematic diagram showing a structure of the fuel supply apparatus of the first embodiment.

The FPC 40 receives an electric power from a battery 11 and controls an electric power, which is supplied to an electric fuel pump (hereinafter, simply referred to as a fuel pump) 34 of the pump module 20 installed in the fuel tank 2, as indicated in FIG. 2. The structure of the fuel supply apparatus 6 will be described in detail later.

The FPC 40 controls the electric power supplied to the fuel pump 34 by controlling an electric current value or an electric voltage value of the electric current supplied to the fuel pump 34. The FPC 40 controls a discharge quantity (delivery quantity) of fuel, which is discharged from the fuel pump 34, by controlling the electric power that is supplied to the fuel pump 34. The FPC 40 is electrically connected to the ECU 9, which serves as an internal combustion engine control device and controls the internal combustion engine 10.

The ECU 9 transmits a command signal (demand signal) to the FPC 40 to provide a required quantity of fuel, which is required by the internal combustion engine 10, so that the FPC 40 controls the electric power to be supplied to the fuel pump 34 in accordance with the command signal to provide the required quantity of fuel from the fuel pump 34 to the internal combustion engine 10. In this way, the required quantity of fuel, which is required by the internal combustion engine 10, is supplied from the fuel supply apparatus 6 to the internal combustion engine 10.

Thereby, it is only required to operate the fuel supply apparatus 6 in response to the required quantity of fuel, which is required by the internal combustion engine 10, and thus it is possible to minimize the electric power consumption of the fuel pump 34, thereby contributing in the reduced electric power consumption of the vehicle. The ECU 9 determines an operational state of the internal combustion engine 10 and a demand of the driver of the vehicle based on signals outputted from various sensors (not shown). Then, based on the determined operational state of the internal combustion engine 10 and the determined demand of the driver (the demand being sensed based on, for example, an accelerator pedal position sensor indicating an operational position of an accelerator pedal), the ECU 9 controls a fuel injection quantity and a fuel injection timing of each corresponding fuel injection valve 8 and outputs the command signal, which corresponds to the required quantity of fuel that is required by the internal combustion engine 10, to the FPC 40.

Figure 3:
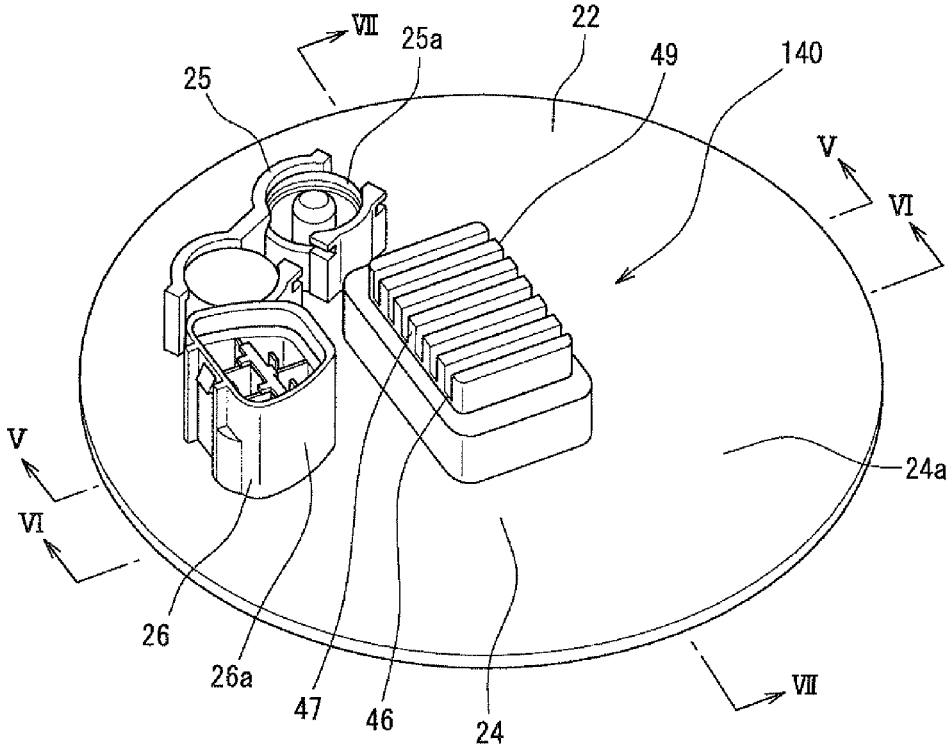
FIG. 3 is a perspective view of a flange of the fuel supply apparatus, to which an FPC is installed according to the first embodiment.
Figure 4:
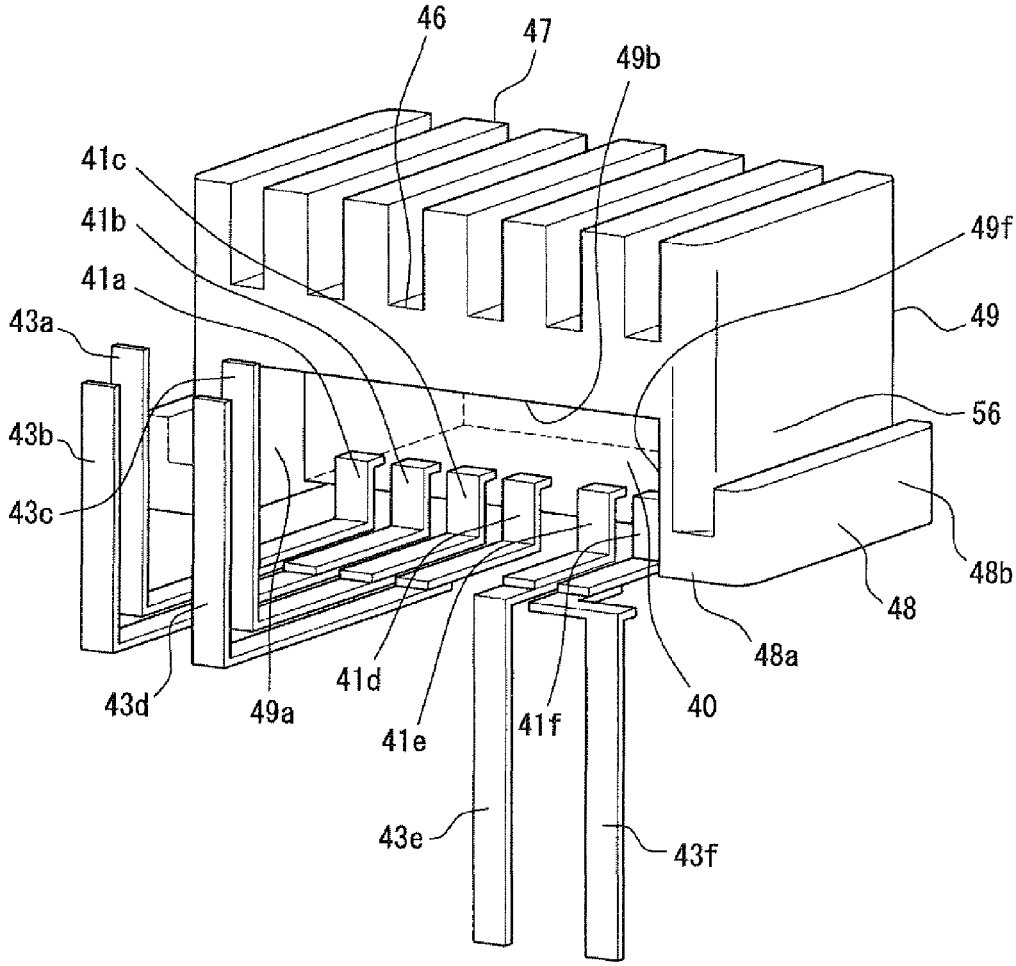
FIG. 4 is a perspective view showing the FPC and a heat releasing member of the fuel supply apparatus shown in FIG. 3.
Figure 5:
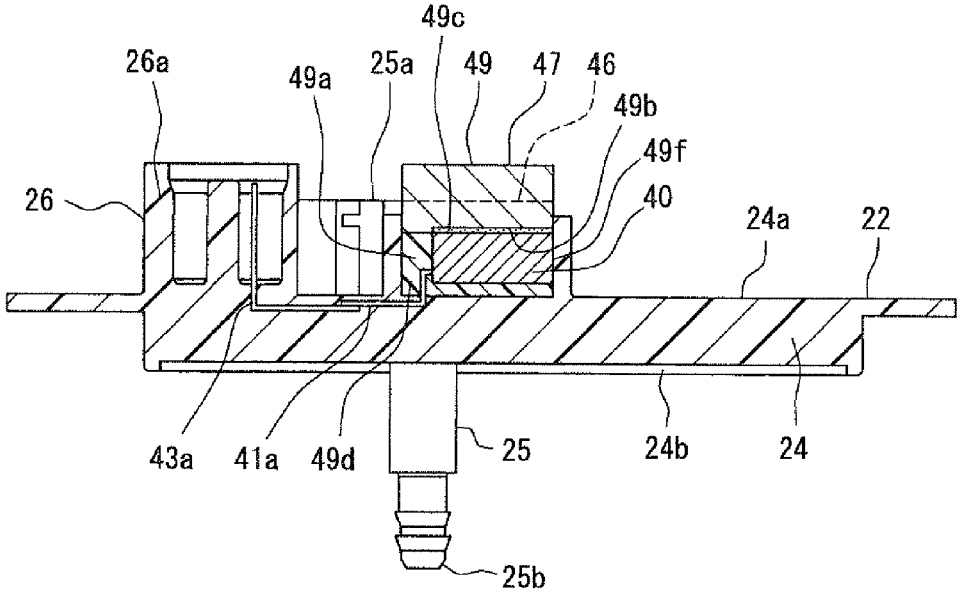
FIG. 5 is a cross sectional view taken along line V-V in FIG. 3.
Figure 6:
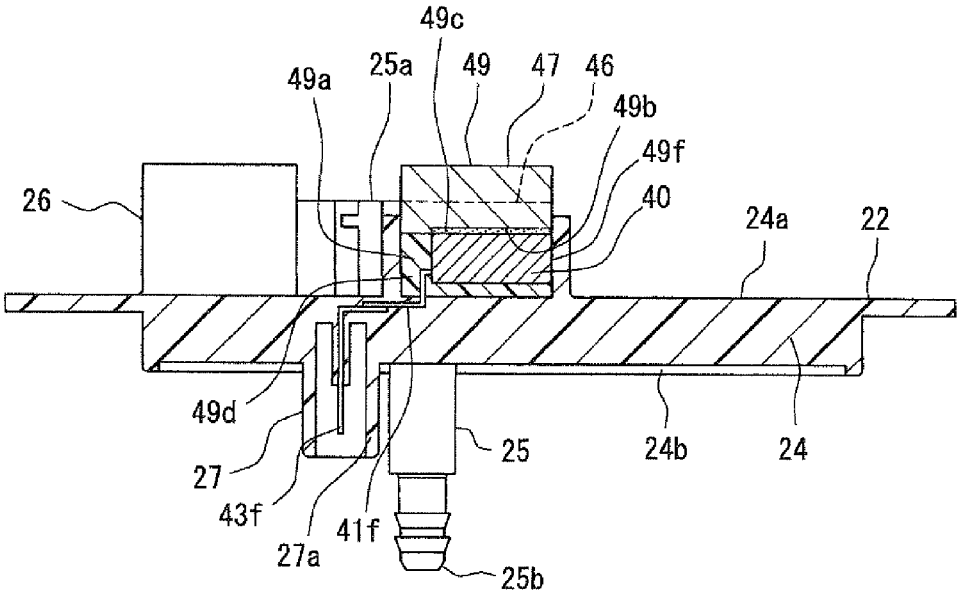
FIG. 6 is a cross sectional view taken along line VI-VI in FIG. 3.
Figure 7:
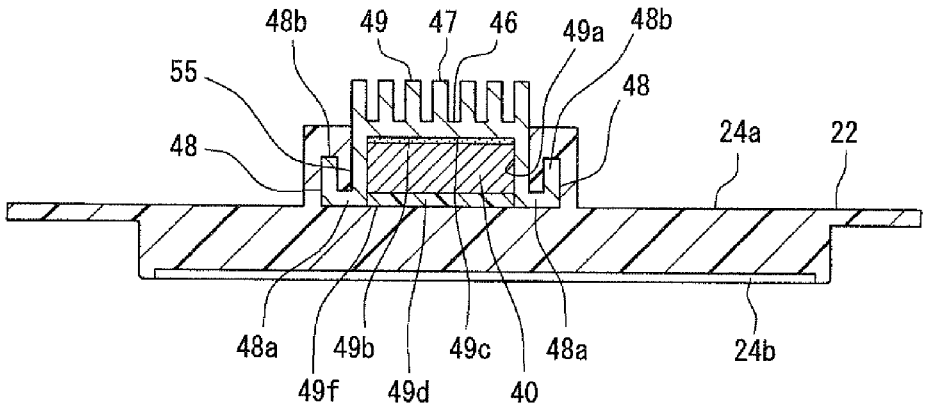
FIG. 7 is a cross sectional view taken along line VII-VII in FIG. 3.

Next, the fuel supply apparatus 6 will be described in detail. FIG. 2 shows a schematic structure of the fuel supply apparatus 6 of the present embodiment. FIG. 3 shows a flange 22, on which the FPC 40 of the control device 140 is installed. FIG. 4 shows the FPC 40 and a heat releasing member (heat sink member) 49 of the control device 140. FIG. 5 is a cross sectional view taken along line V-V in FIG. 3. FIG. 6 is a cross sectional view taken along line VI-VI in FIG. 3. FIG. 7 is a cross sectional view taken along line VII-VII in FIG. 3.

The pump module 20 includes the flange (serving as a cover member) 22, a sub-tank 30, the fuel pump 34, a suction filter 35, a fuel filter 36 and a pressure regulator 39. These components are received in the fuel tank 2 except the flange 22.

The flange 22 is a component, which is configured into a generally circular disc body that covers a generally circular hole (opening) 3 that is formed in a ceiling portion 4 of the fuel tank 2. The flange 22 is formed through a molding process and is made of a resin maternal, which is highly corrosion resistant with respect to gasoline and is dielectric. In this particular instance, the resin material of the flange 22 is poly-oxy-methylene (POM) also known as polyacetal. Here, it should be noted that the resin material of the flange 22 may be changed to any other suitable resin material, which is highly corrosion resistant with respect to gasoline and is dielectric. The flange 22 includes a flange main body 24, a fuel supply pipe 25, a first connector 26 and a second connector 27.

The main body 24 includes a generally circular disc portion and a collar portion (annular portion). When the flange 22 is installed to the hole 3 to cover the same, the circular disc portion of the main body 24 is placed radially inward of a peripheral edge of the hole 3. The collar portion radially outwardly projects from an outer peripheral edge of the circular disc portion and is supported on an outer surface of the fuel tank 2 located radially outward of the hole 3.

In the flange 22, a size (a radial size) of the main body 24, which is measured in a direction generally perpendicular to the axis of the hole 3, is larger than a size (a size in a thickness direction) of the main body 24, which is measured in a direction generally parallel to the axis of the hole 3.

The fuel supply pipe 25 is a pipe member, which supplies the fuel discharged from the fuel pump 34 toward the internal combustion engine 10, and is formed integrally with the main body 24. As shown in FIG. 2, a fluid passage of the fuel supply pipe 25 is formed to penetrate through the main body 24 in the axial direction. An outer end part 25*a* of the fuel supply pipe 25, which projects to the outside of the fuel tank 2, is connected with a fuel supply conduit line 12. An inner end part 25*b* of the fuel supply pipe 25, which projects to the inside of the fuel tank 2, is connected with a fuel hose 28, which is communicated with the fuel pump 34. In this way, the fuel, which is discharged from the fuel pump 34, can be supplied to the internal combustion engine 10.

The first connector 26 is a connector that electrically connects the FPC 40, which is installed to the flange 22, to the external ECU (external device) 9 and the battery 11. The second connector 27 is a connector that electrically connects the FPC 40 to the fuel pump 34.

As indicated by a dotted line in FIG. 2, the FPC 40 is embedded in a center part of the main body 24. Furthermore, the FPC 40 is embedded in the main body 24 through the molding process of the flange 22 in a state where the FPC 40 is received in the heat releasing member 49 discussed in detail below. The heat releasing member 49 radiates, i.e., releases the heat, which is generated from the FPC 40 to the surrounding air. As shown in FIGS. 2 and 3, a portion of the heat releasing member 49 projects from an outer surface 24*a* of the main body 24, which is located at the outside of the fuel tank 2. The term "embedded" generally refers to a state where at least a part of one member is buried in and is fixed to another member, which is formed separately from the one member.

Furthermore, two shafts 31 are provided in the main body 24. The shafts 31 project from an inner surface 24*b* of the main body 24, which is located in the inside of the fuel tank 2, toward a bottom portion 5 of the fuel tank 2 to connect between the sub-tank 30, which is received in the fuel tank 2, and the flange 22. The shafts 31 are placed one after another at generally equal intervals in a circumferential direction along an outer peripheral part of the main body 24. A flange 22 side end part of each of the shafts 31 is press fitted into and is secured to a press-fitting portion, which is provided in the main body 24. A sub-tank 30 side end part of each of the shafts 31 is loosely received in an insertion hole, which is formed in a corresponding insertion hole member 33. The insertion hole members 33 are provided in the sub-tank 30.

A corresponding coil spring 32 is received over each of the shafts 31 to surround the shaft 31. A flange 22 side end part of each coil spring 32 is engaged with the main body 24, and a sub-tank 30 side end part of the coil spring 32 is engaged with a flange 22 side end surface of the corresponding insertion hole member 33. The coil spring 32 is engaged with the main body 24 and the end surface of the insertion hole member 33 in an axially compressed state thereof. In this way, the sub-tank 30 is urged against the bottom portion 5 of the fuel tank 2 by the coil springs 32 in the state where the flange 22 closes the hole 3.

The fuel, which is received in the fuel tank 2, is volatile, so that the fuel is evaporated, i.e., is vaporized in the fuel tank 2. The amount of evaporation of the fuel is largely influenced by the temperature of the fuel. Therefore, the pressure in the fuel tank 2 is not constant, i.e., is variable. In the present embodiment, the fuel tank 2 is made of a resin material. Therefore, a tank wall of the fuel tank 2 may be flexed depending on a change in the pressure in the fuel tank 2. As discussed above, the sub-tank 30 is urged against the bottom portion 5 by the coil springs 32. Therefore, even when the tank wall is flexed due to the change in the pressure in the fuel tank 2, the sub-tank 30 can follow the flexed bottom portion 5. Thereby, the pump module 20 can be stably placed in the fuel tank 2.

The sub-tank 30 is a cup-shaped container, which is made of a resin material and has an opening at a flange 22 side end of the container. The sub-tank 30 receives the fuel pump 34, the fuel filter 36 and the suction filter 35 and stores a portion of the fuel received in the fuel tank 2. The sub-tank 30 includes a jet pump (not shown) that draws the fuel, which is located around the sub-tank 30 in the fuel tank 2, into the interior of the sub-tank 30. The jet pump pumps the fuel when a portion of the fuel, which is discharged from the fuel pump 34, is supplied to the jet pump. In this way, during the time of operating the fuel pump 34, the jet pump pumps the fuel, so that the interior of the sub-tank 30 is filled with the fuel.

The fuel pump 34 is the electric fuel pump and includes an electric motor unit and a pump unit. The pump unit is driven by the electric motor unit. The pump unit includes an impeller and a pump case. The impeller has a plurality of blade grooves, which are arranged one after another in a circumferential direction at an outer peripheral part of the impeller. The pump case receives the impeller and includes a pressurizing flow passage, an inlet port and an outlet port. The pressurizing flow passage is configured into an arcuate passage, which covers the blade grooves. The inlet port and the outlet port are communicated with the pressurizing flow passage. The electric motor unit is electrically connected to the FPC 40 through electric lines 29*e*, 29*f* and the second connector 27. When the electric motor unit receives the controlled electric power from the FPC 40, a rotor of the electric motor unit is rotated to rotate the impeller.

When the impeller is rotated, the fuel, which is drawn through the inlet port, is pressurized in the pressurizing flow passage and is discharged from the pressurizing flow passage through the outlet port. The discharged fuel, which is discharged from the outlet port, passes through an interior of the electric motor unit and is discharged from the electric motor unit through a fuel discharge port, which is provided at an upper end part of the electric motor unit, toward the fuel filter 36. A suction port is provided at a lower end part of the pump unit. The suction filter 35 is connected to the suction port to filter the fuel to be drawn through the suction port. The suction filter 35 is made of a nonwoven fabric, which is produced from resin fibers (e.g., polyester fibers or nylon fibers) and is configured into a bag form. The suction filter 35 is installed to the suction port.

The fuel filter 36 is a filter, which further filters the fuel discharged from the fuel pump 34. The fuel filter 36 includes a filter case 37 and a filter element 38. The filter case 37 covers an upper end part and an outer peripheral part of the fuel pump 34. The filter element 38 filters the fuel discharged from the fuel pump 34. A receiving portion, which receives the filter element 38, is formed in the interior of the filter case 37. The pressure regulator 39 is provided at a location radially outward of the filter case 37. The pressure regulator 39 adjusts, i.e., regulates the pressure of the fuel, which is filtered through the filter element 38, and the fuel of the adjusted pressure is discharged from the pressure regulator 39 toward the fuel hose 28.

In the above description, the fuel supply apparatus 6 has been described. Next, the structure of the flange 22, to which the FPC 40 and the heat releasing member 49 are installed, will be described in detail.

As shown in FIGS. 2 and 3, the FPC 40 and the heat releasing member 49 are installed at the center part of the flange 22. As shown in FIG. 4, the FPC 40 is received in a receiving portion (receiving space) 49*a* of the heat releasing member 49. As discussed above, the FPC 40 controls the electric power, which is supplied to the fuel pump 34, based on the command received from the ECU 9. The FPC 40 is formed as a control circuit, more specifically a hybrid integrated circuit (IC) that is constructed by placing corresponding components, such as a control IC and power metal oxide semiconductor field effect transistors (MOSFETs), into a common package. FIG. 4 shows a plurality of electrically conductive line members (four electrically conductive line members in this instance) 43*a*-43*d*, which are components of the first connector 26 and are electrically connected to the FPC 40. FIG. 4 also shows a plurality of electrically conductive line members (two electrically conductive line members in this instance) 43*e*, 43*f*, which are components of the second connector 27 and are electrically connected to the FPC 40. The electrically conductive line members 43*a*-43*f* are also simply referred to as conductive line members 43*a*-43*f*.

The FPC 40 includes a plurality of terminals (four terminals in this instance) 41*a*-41*d*, each of which is electrically connected to a corresponding one of the ECU 9 and the battery 11. The FPC 40 also includes a plurality of terminals (two terminals in this instance) 41*e*, 41*f*, which are electrically connected to the fuel pump 34. The terminals 41*a*-41*f* are arranged one after another in a row along a direction generally perpendicular to the axis of the hole 3.

Specifically, the terminal 41*a* is a control terminal, which receives the command signal outputted from the ECU 9 to the control IC of the FPC 40. The terminal 41*b* is a diagnosis terminal, which is used for diagnosing the control IC by the ECU 9. The terminal 41*c* is an electric power source terminal, which receives the electric power from the battery 11. The terminal 41*d* is a ground terminal, which is grounded to, i.e., is earthed to, for example, a body of the vehicle. The terminals 41*e*, 41*f* are power supply terminals, through which the electric power is supplied to the fuel pump 34.

Each of the terminals 41*a*-41*d* is electrically conned to one end part of a corresponding one of the conductive line members 43*a*-43*d* of the first connector 26 by, for example, welding (see FIGS. 4 and 5). The other end part of each of the conductive line members 43*a*, 43*b* is electrically connected to the ECU 9 through a corresponding electric line (not shown). The other end part of the conductive line member 43*c* is electrically connected to a positive battery terminal (labeled with a "+" on the battery 11) through a corresponding electric line (not shown). The other end part of the conductive line member 43*d* is electrically connected to the body of the vehicle through a corresponding electric line (not shown).

Each of the terminals 41*e*, 41*f* is electrically conned to one end part of a corresponding one of the conductive line members 43*e*, 43*f* of the second connector 27 by, for example, welding (see FIGS. 4 and 6). The other end part of the conductive line member 43*e* is electrically connected to a positive terminal of the fuel pump 34 through the corresponding electric line 29*e*. The other end part of the conductive line member 43*f* is electrically connected to a negative terminal of the fuel pump 34 through the corresponding electric line 29*f*.

For instance, the control IC executes a switching control operation of the power MOSFETs through pulse width modulation (PWM) according to the command signal received from the ECU 9 through the terminal 41*a* to provide the corresponding electric power to the fuel pump 34. The FPC 40 supplies the controlled electric power to the fuel pump 34 through the terminals 41*e*, 41*f*. In the present embodiment, the rotational speed of the fuel pump 34 is adjusted in this way.

With reference to FIG. 4, the heat releasing member 49 is made of a metal material (e.g., aluminum or aluminum alloy), which has a relatively high heat conductivity (a relatively high coefficient of conductivity), and is configured into a box form (quadrangular prismatic form). In this instance, the heat releasing member 49 is made as a single integral member. With reference to FIGS. 4 to 7, in the heat releasing member 49, the receiving portion 49*a*, which is configured as the recess, has an opening 49*f* on a flange 22 side thereof (bottom side in FIG. 4). More specifically, the opening 49*f* of the heat releasing member 49 opens in a downward direction that is generally parallel to the axis of the hole 3 (a vertical direction, i.e., a top-to-bottom direction of the fuel tank 2) and also opens in a direction generally perpendicular to the axis of the hole 3. A size of the opening 49*f* is set to permit insertion of the FPC 40 into the receiving portion 49*a* through the opening 49*f*.

The FPC 40 is fixed to a base part 49*b* of the receiving portion 49*a*, which is located on a side that is opposite from the flange 22 in a direction of the axis of the hole 3, through a bonding agent layer 49*c*, which is made of a silicone bonding agent. In this way, the FPC 40 is received in the receiving portion 49*a* in the contact state thereof where the FPC 40 contacts the inner wall surface of the receiving portion 49*a*. Here, the contact state, in which the FPC 40 contacts the inner wall surface of the receiving portion 49*a*, should refer to both of a direct contact state, in which the FPC 40 directly contacts the inner wall surface of the receiving portion 49*a*, and an indirect contact state, in which the FPC 40 indirectly contacts the inner wall surface of the receiving portion 49*a* through the bonding agent layer 49*c* as long as the heat can be conducted from the FPC 40 to the wall of the receiving portion 49*a* without substantially forming a layer of air (air gap) between the FPC 40 and the inner wall surface of the receiving portion 49*a*. Furthermore, the terminals 41*a*-41*f* project from the opening 49*f* of the heat releasing member 49 in the direction generally perpendicular to the axis of the hole 3 and is generally perpendicular to the direction of the row of the terminals 41*a*-41*f*.

As shown in FIGS. 5 and 6, a resin portion (resin filling) 49*d* is formed, i.e., is molded in a remaining space of the receiving portion 49*a*, which is left upon receiving the FPC 40 in the receiving portion 49*a*. The resin portion 49*d* may also be referred to as a protective member. The resin portion 49*d* is made of a different resin material, such as polyphenylene sulfide (PPS), which is different from the resin material of the flange 22. Alternatively, the resin portion 49*d* may be made the material that is the same as that (e.g., POM) of the flange 22. In this way, the anchorage strength of the FPC 40 relative to the heat releasing member 49 is further improved.

The heat releasing member 49 has an outer wall surface 46 at an opposite end part of the heat releasing member 49, which is opposite from the receiving portion 49*a* in the direction of the axis of the hole 3. The outer wall surface 46 of the heat releasing member 49 projects from the outer surface 24*a* of the main body 24 of the flange 22 in the state where the heat releasing member 49 is embedded in the flange 22. Furthermore, a plurality of fins 47 is formed integrally on the outer wall surface 46 to project upwardly away from the FPC 40 in the direction generally parallel to the axis of the hole 3.

The heat releasing member 49 has an embeddable portion 56, which is formed at least along a peripheral edge of the opening 49*f* of the receiving portion 49*a* and is adapted to be embedded in the flange 22 (see FIG. 4). In the present embodiment, the peripheral edge of the opening 49*f* refers to a surround edge of the heat releasing member 49, which surrounds the opening 49*f* on an outer side of the opening 49*f*. When the embeddable portion 56 is embedded in the flange 22, the opening 49*f* is closed with the resin material of the flange 22 (see FIG. 7). Thereby, the FPC 40 and the heat releasing member 49 are fixed to the flange 22, and the interior of the receiving portion 49*a* is isolated from the outside.

A plurality of projections 48 is formed at the embeddable portion 56 to project outwardly from the embeddable portion 56. In this instance, the projections 48 include two projections 48. Each projection 48 has a first projecting part 48*a* and a second projecting part 48*b*.

As shown in FIGS. 4 and 7, the first projecting part 48*a* projects from the embeddable portion 56 in a direction, which is generally perpendicular to the axis of the hole 3 and is generally parallel to the direction of the row of the terminals 41*a*-41*f*. In the projection 48, the second projecting part 48*b* projects from the first projecting part 48*a* in a direction parallel to the axis of the hole 3 of the fuel tank 2 while a gap is provided between the second projecting part 48*b* and the embeddable portion 56. The first and second projecting parts 48*a*, 48*b* are also adapted to be embedded in the flange 22.

In the present embodiment, the first projecting part 48*a* projects from the embeddable portion 56 in the direction generally perpendicular to the axis of the hole 3, and the second projecting part 48*b* projects from a distal end of the first projecting part 48*a* toward the fin 47 side in the direction generally parallel to the axis of the hole 3. With reference to FIG. 7, each projection 48 includes the first projecting part 48*a* and the second projecting part 48*b*, as discussed above. Therefore, when the embeddable portion 56 is embedded in the flange 22 in the molding process, the resin material of the flange 22 is filled in the gap between the embeddable portion 56 and the second projecting part 48*b*. A length of the second projecting part 48*b*, which is measured in the direction generally parallel to the axis of the hole 3, is set such that the second projecting part 48*b* does not project outward from the outer surface 24*a* in the state where the embeddable portion 56 is embedded in the flange 22.

The FPC 40 and the heat releasing member 49 have been described in detail above. Next, the flange 22 will be described in detail.

The first connector 26, which is formed in the flange 22, includes the conductive line members 43*a*-43*d* and a first connector housing 26*a*. The second connector 27, which is also formed in the flange 22, includes the conductive line members 43*e*, 43*f* and a second connector housing 27*a*.

As shown in FIGS. 3 and 5, the first connector housing 26*a* is integrally formed with the main body 24 such that the first connector housing 26*a* projects upwardly from the outer surface 24*a*. The first connector housing 26*a* is configured into a tubular form such that the first connector housing 26*a* surrounds the conductive line members 43*a*-43*d* while the other end parts of the conductive line members 43*a*-43*d* are exposed to the outside of the first connector housing 26*a*. The unexposed sections of the conductive line members 43*a*-43*d* are embedded in the main body 24 through the molding process.

As shown in FIG. 6, the second connector housing 27*a* is integrally formed with the main body 24 such that the second connector housing 27*a* projects downwardly from the inner surface 24*b*. The second connector housing 27*a* is configured into a tubular form such that the second connector housing 27*a* surrounds the conductive line members 43*e*, 43*f* while the other end parts of the conductive line members 43*e*, 43*f* are exposed to the outside of the second connector housing 27*a*. The unexposed sections of the conductive line members 43*e*, 43*f* are embedded in the main body 24 through the molding process.

In the present embodiment, the flange 22 serves as the cover member, and the FPC 40 serves as a controller. A wall surface of the base part 49*b* of the receiving portion 49*a* of the heat releasing member 49 serves as an inner wall surface of the heat releasing member 49. In addition, the first connector housing 26*a* serves as a first housing, and the second connector housing 27*a* serves as a second housing. Also, the conductive line members 43*a*-43*d* serve as first side conductive line members, and the conductive line members 43*e*, 43*f* serve as second side conductive line members.

The structure of the flange 22 has been described in detail above. Next, the operation of the fuel supply apparatus 6 will be described in detail.

The FPC 40 receives the command signal from the ECU 9. The FPC 40 controls the electric power to be supplied to the fuel pump 34 according to the command signal. The fuel pump 34 is driven in response to the supplied electric power (the supplied amount of electric current) to draw the fuel, which is filtered through the suction filter 35, and to discharge the drawn fuel toward the fuel filter 36 upon pressurizing the drawn fuel. The discharged fuel is filtered through the fuel filter 36 and is conducted toward the pressure regulator 39. The pressure regulator 39 adjusts, i.e., regulates the pressure of the fuel and outputs the pressure-regulated fuel toward the fuel hose 28. The pressure-regulated fuel is supplied to the internal combustion engine 10 through the fuel hose 28, the fuel supply pipe 25, the fuel supply conduit line 12, the delivery pipe 7 and the fuel injection valve 8.

Here, the FPC 40 generates heat when the FPC 40 controls the electric power supplied to the fuel pump 34. This heat is conducted to the base part 49*b* of the receiving portion 49*a* of the heat releasing member 49 through the bonding agent layer 49*c*. Thereafter, the heat is conducted to the fins 47, which are formed at the outer wall surface 46. The heat, which is conducted to the fins 47 at the outside of the fuel tank 2, undergoes a heat exchange with the air located outside of the fuel tank 2, thereby being released to the surrounding atmosphere.

Next, the manufacturing process of the flange 22 will be described in detail. First of all, the FPC 40 is placed into the receiving portion 49*a* through the opening 49*f* of the heat releasing member 49. Then, the FPC 40 is bonded to the wall surface of the receiving portion 49*a* of the heat releasing member 49 with the silicone bonding agent. Then, the conductive line members 43*a*-43*f* are connected, i.e., are joined to the terminals 41*a*-41*f* of the FPC 40 by, for example, welding. As shown in FIG. 4, the conductive line members 43*a*-43*f* are bent in an appropriate manner, so that upon placement of the conductive line members 43*a*-43*f* on the flange 22, the other end parts of the conductive line members 43*a*-43*d* are placed in the first connector housing 26*a*, and the other end parts of the conductive line members 43*e*, 43*f* are placed in the second connector housing 27*a*.

Next, the molten resin material, which forms the resin portion (resin filling) 49*d* upon the hardening (curing) of the molten resin material, is filled in the receiving portion 49*a*, in which the FPC 40 is received. In the above described manner, there is formed an intermediate molded product (the control device 140), in which the FPC 40 is received in the heat releasing member 49.

In the present embodiment, the flange 22 is manufactured by insert-molding the intermediate molded product in the flange 22. Specifically, the intermediate molded product is placed in a molding die, which is adapted to mold the main body 24, the fuel supply pipe 25, the first connector housing 26*a* and the second connector housing 27*a*, and the molten resin material is filled in a cavity of the molding die.

In this way, the embeddable portion 56 of the heat releasing member 49 is embedded in the flange 22 such that the opening 49*f* of the receiving portion 49*a* of the heat releasing member 49 is closed with the resin material of the flange 22, and the corresponding portions of the terminals 41*a*-41*f* and the corresponding portions of the conductive line members 43*a*-43*f* are embedded in the flange 22. Thereby, the flange 22, on which the FPC 40 is installed, is formed.

According to the present embodiment, the embeddable portion 56 is embedded in the flange 22, so that the opening 49*f* is closed by the resin material of the flange 22. As a result, the FPC 40, which is received in the receiving portion 49*a*, is isolated from the outside (i.e., being completely isolated from the surrounding atmosphere). Therefore, according to the present embodiment, the FPC 40 can be protected with the simple structure without a need for the separate dedicated member, which is dedicated to cover the opening 49*f*. Furthermore, since the embeddable portion 56 of the heat releasing member 49 is embedded in the flange 22, the heat releasing member 49 can be securely fixed to the flange 22 without a need for the separate dedicated fixing means (such as the screws). According to the present embodiment, the FPC 40 can be protected with the simple structure, and the fuel supply apparatus 6, which includes the flange 22 having the high heat releasing performance, can be provided.

Also, in the present embodiment, the flange 22, to which the FPC 40 and the heat releasing member 49 are installed by the insert-molding, is produced, so that the fluid tightness (both liquid tightness and air tightness) of the receiving portion 49*a* can be easily improved. Thus, intrusion of the water (both liquid water and moisture) and the dust into the FPC 40 can be limited without a need for the gasket.

In addition, according to the present embodiment, the outer wall surface 46 of the heat releasing member 49 projects from the main body 24. In this way, the outer wall surface 46 may contact the external air, which is present at the outside of the fuel tank 2, or a gas mixture of the air and fuel vapor, which is present in the fuel tank 2. Therefore, the heat releasing performance of the heat releasing member 49 can be improved. Furthermore, in the present embodiment, there is provided the structure of releasing the heat through the outer wall surface 46. Therefore, unlike the prior art technique, it is not required to contact the heat releasing member to, for example, the metal fuel pipe. Therefore, the fixation location of the FPC 40 (and thereby the control device 140) can be set to any desired location (thereby implementing a greater design freedom in terms of the location of the FPC 40). In other words, the same control device 140 can used for different types of flanges without a need for changing the structure of the control device 140. Since a degree of design freedom of the flange 22 is increased in this way, the structure of the flange 22 can be simplified.

Furthermore, in the present embodiment, the outer wall surface 46 is exposed to the outside of the fuel tank 2. In this way, the heat releasing performance of the heat releasing member 49 can be increased in comparison to the case where the heat releasing member 49 is placed in the inside of the fuel tank 2. This is due to the following reason. That is, the operation of the fuel pump 34 may cause an increase in the temperature of the fuel to cause an increase in the temperature at the inside of the fuel tank in comparison to the temperature of the external air. Therefore, it is better to expose the outer wall surface 46 of the heat releasing member 49 to the outside of the fuel tank 2 to improve the heat releasing performance.

In the present embodiment, the fins 47 are formed in the outer wall surface 46. In this way, a total surface area of the outer wall surface 46 is increased, so that the heat releasing performance of the heat releasing member 49 can be further increased.

In addition, the heat releasing member 49 includes the projections 48, which project from the embeddable portion 56. With this structure, a total surface area of the embedded region of the heat releasing member 49, which is embedded in the flange 22, is increased in comparison to the case where the heat releasing member does not have the projections 48. That is, a total contact surface area of the heat releasing member 49, which contacts the resin material of the flange 22, is increased. Thereby, an anchorage strength of the heat releasing member 49 relative to the flange 22 is increased.

In addition, each projection 48 has the first projecting part 48*a* and the second projecting part 48*b*. Thereby, even when the flange 22 is swelled with the fuel or is thermally expanded due to the application of the heat thereto to induce a movement (displacement) of the resin material around the projection 48 in a direction perpendicular to the axis of the hole 3 of the flange 22, such a movement is effectively limited by the second projecting part 48*b*. Therefore, it is possible to limit a reduction in the anchorage strength of the heat releasing member 49 relative to the flange 22, which would be otherwise induced by the separation of the resin material from the heat releasing member 49.

As discussed above, due to the provision of the first projecting part 48*a* and the second projecting part 48*b* in the projection 48, the reduction in the anchorage strength of the heat releasing member 49 can be advantageously limited. Thus, even though the outer wall surface 46 of the heat releasing member 49 projects from the outer surface 24*a* of the flange 22 to reduce the total contact surface area of the heat releasing member 49 relative to the flange 22, it is possible to effectively limit the reduction in the anchorage strength of the heat releasing member 49 relative to the flange 22. With the above described combination of the features, it is possible to achieve both of the sufficient anchorage strength of the heat releasing member 49 to the flange 22 and the sufficient heat releasing performance of the heat releasing member 49.

Also, in the present embodiment, the first connector housing 26*a* and the second connector housing 27*a* are integrally formed in the dielectric main body 24, and the conductive line members 43*a*-43*f* are embedded in the dielectric main body 24. Thereby, it is not required to provide the connector housing(s) at the heat releasing member 49. In addition, the heat releasing member 49 does not need to have an insulating member, which electrically insulate between the conductive line members 43*a*-43*f* and the heat releasing member 49. Thereby, the structure of the heat releasing member 49 can be simplified, and the number of the components can be minimized.

Furthermore, in the present embodiment, the receiving portion 49*a* forms the opening 49*f*, which opens downwardly and transversely. Each of the terminals 41*a*-41*f* is placed to project from the opening 49*f* of the receiving portion 49*a* to the outside of the receiving portion 49*a*. Thereby, the opening 49*f* of the simple configuration can be used as the path, through which the terminals 41*a*-41*f* are extended outside of the receiving portion 49*a*, so that the structure of the heat releasing member 49 can be simplified.

The FPC 40 is bonded to the wall of the receiving portion 49*a* of the heat releasing member 49 with the silicone bonding agent. With this structure, even in a case where the FPC 40 and the heat releasing member 49 are displaced from each other due to a difference between a thermal expansion coefficient (a coefficient of thermal expansion) of the outer surface of the FPC 40 and a thermal expansion coefficient of the heat releasing member 49, such a displacement can be compensated or absorbed with the silicone bonding agent because of its elasticity. Thereby, the contact state between the FPC 40 and the heat releasing member 49 can be maintained through the bonding agent layer 49*c*. In this way, it is possible to limit a reduction in the heat conducting performance between the FPC 40 and the heat releasing member 49 caused by formation of a gap therebetween.

The silicone bonding agent has a higher flexibility in comparison to, for example, an epoxy bonding agent. The present embodiment uses this characteristic nature of the silicone bonding agent. In the case where the silicone bonding agent is used in the above described manner, even when the displacement occurs between the FPC 40 and the heat releasing member 49 due to the heat generated from the FPC 40, such a displacement can be compensated or absorbed by the silicone bonding agent.

Second Embodiment

With reference to FIGS. 8 to 12 in view of FIGS. 1 to 3 discussed above, a fuel supply apparatus 6 according to a second embodiment of the present invention will be described. In the present embodiment and the subsequent embodiments, components similar to those discussed in the first embodiment will be indicated by the same reference numerals and will not be discussed redundantly for the sake of simplicity.

Figure 8:
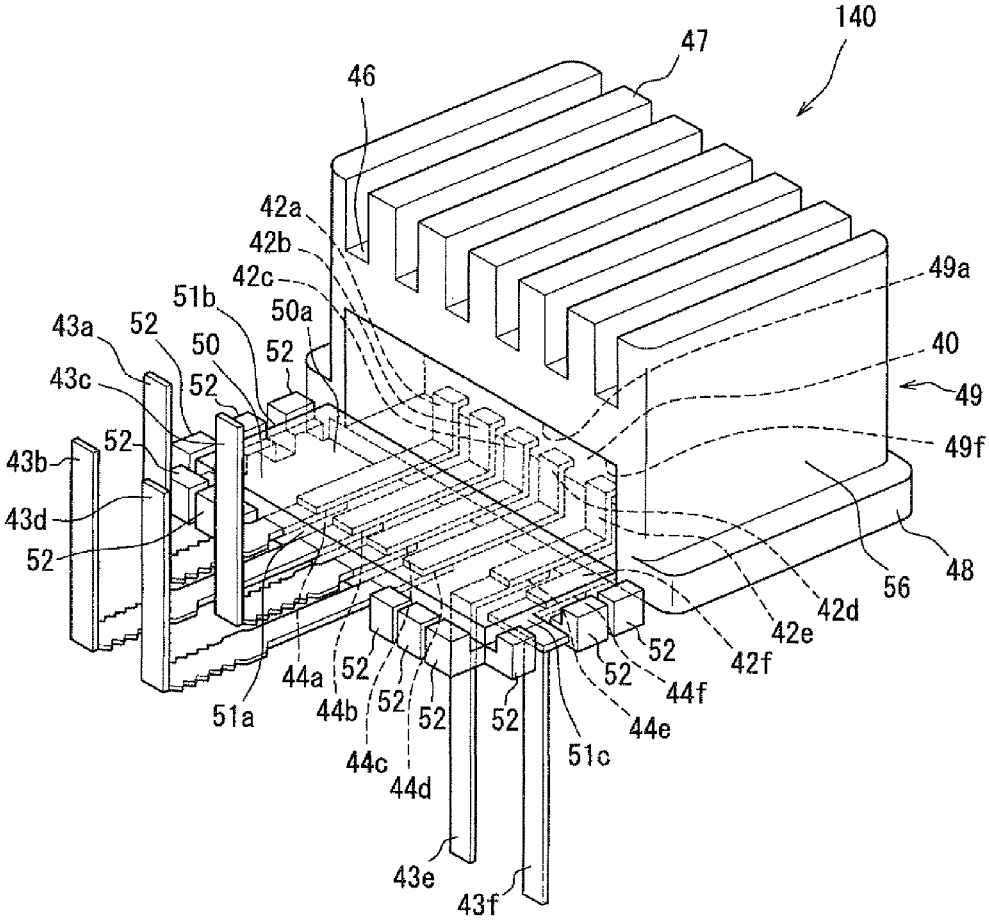
FIG. 8 is a perspective view showing an FPC and a heat releasing member of a fuel supply apparatus according to a second embodiment of the present invention.
Figure 9:
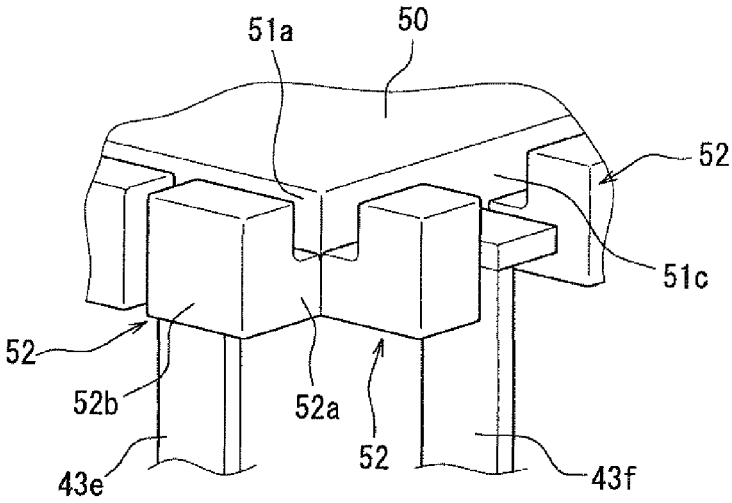
FIG. 9 is an enlarged partial view of a portion of a protective member shown in FIG. 8.

Similar to the first embodiment shown in FIGS. 2 and 3, in the second embodiment, the FPC 40 and the heat releasing member 49 of the control device 140 are installed at the center part of the flange 22. As shown in FIG. 8, the FPC 40 is received in the receiving portion (receiving space) 49*a* of the heat releasing member 49. Besides the FPC 40 and the heat releasing member 49, a protective member 50 (discussed in detail below) is also buried in the flange 22. FIG. 9 shows anchor portions 52 of the protective member 50.

As discussed above; the FPC 40 controls the electric power, which is supplied to the fuel pump 34, based on the command received from the ECU 9. The FPC 40 is formed as the hybrid integrated circuit (IC) that is constructed by placing the corresponding components, such as the control IC and the power metal oxide semiconductor field effect transistors (MOSFETs), into the common package. FIG. 8 shows a plurality of conductive line members (four conductive line members in this instance) 43*a*-43*d*, which are components of the first connector 26 and are electrically connected to the FPC 40. FIG. 9 also shows a plurality of conductive line members (two conductive line members in this instance) 43*e*, 43*f*, which are components of the second connector 27 and are electrically connected to the FPC 40.

The FPC 40 includes a plurality of terminals (four terminals in this instance) 42*a*-42*d*, which are electrically connected to the ECU 9 and the battery 11. The FPC 40 also includes a plurality of terminals (two terminals in this instance) 42*e*, 42*f*, which are electrically connected to the fuel pump 34. The terminals 42*a*-42*f* are arranged one after another in a row along a direction generally perpendicular to the axis of the hole 3.

The terminal 42*a* is a control terminal, which receives the command signal outputted from the ECU 9 to the control IC. The terminal 42*b* is a diagnosis terminal, which is used for diagnosing the control IC by the ECU 9. The terminal 42*c* is an electric power source terminal, which receives the electric power from the battery 11. The terminal 42*d* is a ground terminal, which is grounded to, i.e., is earthed to, for example, a body of the vehicle. The terminals 42*e*, 42*f* are power supply terminals, through which the electric power is supplied to the fuel pump 34.

Figure 10:
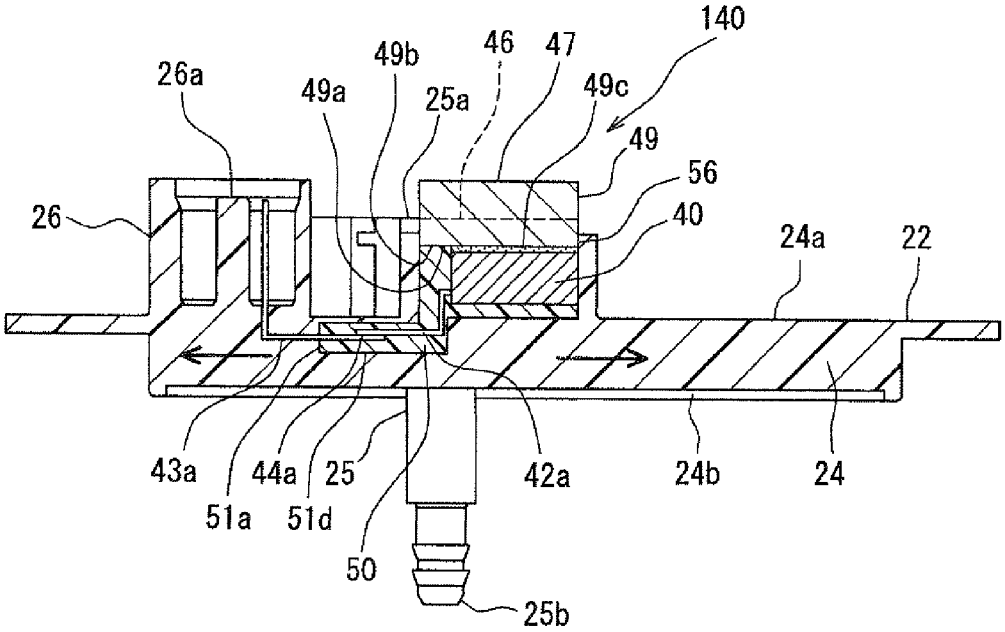
FIG. 10 is a cross sectional view of a flange of the fuel supply apparatus of the second embodiment, being similar to FIG. 5 taken along line V-V in FIG. 3.

One end part of each of the conductive line members 43*a*-43*d* is electrically connected to a corresponding one of the terminals 42*a*-42*d* by, for example, welding (see FIGS. 8 and 10). More specifically, a connecting portion 44*a*-44*d* is formed at a location where the one end part of the corresponding one of the conductive line members 43*a*-43*d* is connected to the corresponding one of the terminals 42*a*-42*d*. The other end part of each of the conductive line members 43*a*-43*d* is exposed from the outer surface 24*a* (see FIG. 10). More specifically, the other end parts of the conductive line members 43*a*-43*d* are received in the first connector housing 26*a* such that each of the other end parts of the conductive line members 43*a*-43*d* is connectable with a corresponding one of the ECU 9 and the battery 11.

Figure 11:
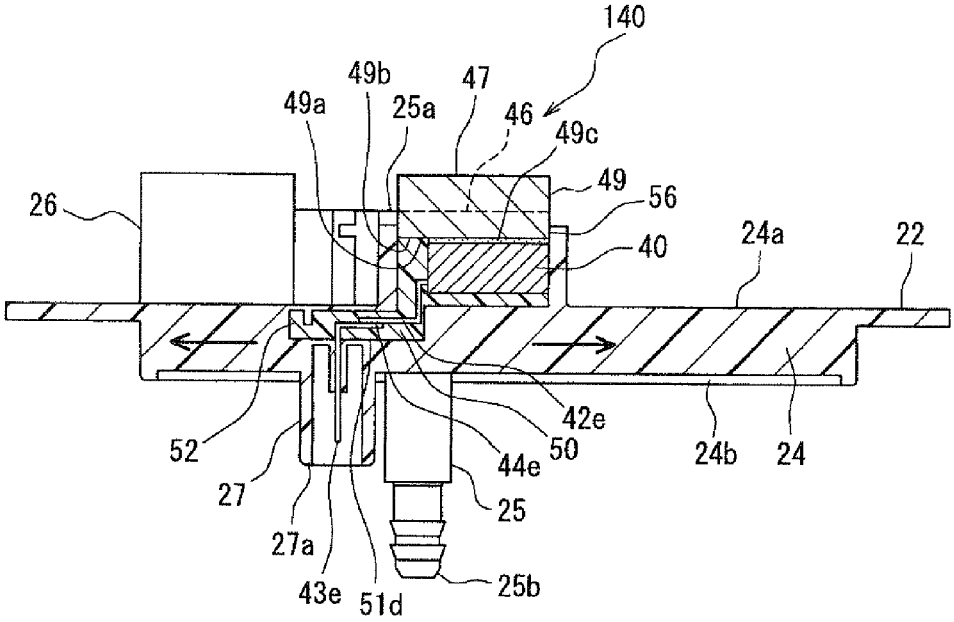
FIG. 11 is another cross sectional view of the flange of the fuel supply apparatus of the second embodiment, being similar to FIG. 6 taken along line VI-VI in FIG. 3.

One end part of each of the conductive line members 43*e*, 43*f* is electrically connected to a corresponding one of the terminals 42*e*, 42*f* by, for example, welding (see FIGS. 8 and 11). More specifically, a connecting portion 44*e*, 44*f* is formed at a location where the one end part of the corresponding one of the conductive line members 43*e*, 43*f* is connected to the corresponding one of the terminals 42*e*, 42*f*. The other end part of each of the conductive line members 43*e*, 43*f* is exposed from the inner surface 24*b* (see FIG. 11). More specifically, the other end parts of the conductive line members 43*e*, 43*f* are received in the second connector housing 27*a* such that the other end parts of the conductive line members 43*e*, 43*f* are electrically connectable to the fuel pump 34

As shown in FIGS. 8, 10 and 11, according to the present embodiment, each of the terminals 42*a*-42*f* is made of an electrically conductive metal material and is configured into a plate form (strip form). Furthermore, distal end parts of the terminals 42*a*-42*f*, which are connected to the conductive line members 43*a*-43*f*, respectively, project from the heat releasing member 49 in a common direction, which is generally perpendicular to the axis of the hole 3, so that the terminals 42*a*-42*f* are arranged one after another in the row along the direction generally perpendicular to the projecting direction of the distal end parts of the terminals 42*a*-42*f*.

Also, each of the conductive line members 43*a*-43*f* is made of an electrically conductive metal material and is configured into a plate form (strip form). Each of the conductive line members 43*a*-43*d* is bent to have a transversely extending section and a vertically extending section. Specifically, in each of the conductive line member 43*a*-43*d*, the transversely extending section extends toward the corresponding terminal 42*a*-42*d* in a direction, which is generally perpendicular to the axis of the hole 3 and is generally perpendicular to the direction of the row of the terminals 42*a*-42*f*, and the vertically extending section extends toward the outer surface 24*a* of the flange 22 in a direction generally parallel to the axis of the hole 3 from an end of the transversely extending section that is opposite from the terminal 42*a*-42*d* (as shown in FIGS. 8 and 10). A portion of the vertically extending section of each of the conductive line members 43*a*-43*d*, which extends toward the outer surface 24*a*, is exposed from the outer surface 24*a* (see FIG. 10).

The conductive line member 43*e* is bent to have a transversely extending section and a vertically extending section. Specifically, in the conductive line member 43*e*, the transversely extending section extends toward the terminal 42*e* in a direction, which is generally perpendicular to the axis of the hole 3 and is generally perpendicular to the direction of the row of the terminals 42*a*-42*f*, and the vertically extending section extends toward the inner surface 24*b* of the flange 22 in a direction generally parallel to the axis of the hole 3 from an end of the transversely extending section that is opposite from the terminal 42*e* (as shown in FIGS. 8 and 11). A portion of the vertically extending section of the conductive line member 43*e*, which extends toward the inner surface 24*b*, is exposed from the inner surface 24*b* (see FIG. 11).

The conductive line member 43*f* is bent to have a transversely extending section and a vertically extending section. Specifically, in the conductive line member 43*f*, the transversely extending section is configured into an L-shape in a view taken in the direction of the axis of the hole 3 and extends toward the terminal 42*f* in a direction, which is generally perpendicular to the axis of the hole 3 and is generally perpendicular to the direction of the row of the terminals 42*a*-42*f*, and the vertically extending section extends toward the inner surface 24*b* of the flange 22 in a direction generally parallel to the axis of the hole 3 from an end of the transversely extending section that is opposite from the terminal 42*f* (as shown in FIG. 8). A long side of the L-shaped transversely extending section of the conductive line member 43*f* forms the one end part of the conductive line member 43*f*, which is connected to the terminal 42*f* at the connecting portion 44*f*, and a short side of the L-shaped transversely extending section of the conductive line member 43*f* extends toward a side opposite from the adjacent conducive line member 43*e* in the direction of the row of the terminals 42*a*-4 direction of the row of the terminals 42*a*-42*f* (see FIG. 8). A portion of the vertically extending section of the conductive line member 43*f*, which extends toward the inner surface 24*b*, is exposed from the inner surface 24*b*.

In the present embodiment, each of the connecting portions 44*a*-44*f* is formed between a lower surface of the corresponding terminal 42*a*-42*f*, which is located on a lower side in the direction of the axis of the hole 3, and an opposed surface of the corresponding adjacent conductive line member 43*a*-43*f*, which is opposed to the lower surface of the corresponding terminal 42*a*-42*f* in the direction of the axis of the hole 3.

The other end part of each of the conductive line members 43*a*, 43*b* is electrically connected to the ECU 9 through a corresponding electric line (not shown). The other end part of the conductive line member 43*c*, which is exposed from the outer surface 24*a*, is electrically connected to a positive battery terminal (labeled with a "+" on the battery 11) through a corresponding electric line (not shown). The other end part of the conductive line member 43*d*, which is exposed from the outer surface 24*a*, is electrically connected to the body of the vehicle through a corresponding electric line (not shown). The other end part of the conductive line member 43*e*, which is exposed from the inner surface 24*b*, is electrically connected to a positive terminal of the fuel pump 34 through the corresponding electric line 29*e*. The other end part of the conductive line member 43*f* is electrically connected to a negative terminal of the fuel pump 34 through the corresponding electric line 29*f*.

As discussed in the first embodiment, the control IC executes the switching control operation of the power MOSFETs through pulse width modulation (PWM) according to the command signal received from the ECU 9 through the terminal 41*a* to provide the corresponding electric power to the fuel pump 34. The FPC 40 supplies the controlled electric power to the fuel pump 34 through the terminals 42*e*, 42*f*. In the present embodiment, the rotational speed of the fuel pump 34 is adjusted in this way.

With reference to FIG. 8, the heat releasing member 49 is made of the metal material (e.g., aluminum or aluminum alloy), which has the relatively high heat conductivity (the relatively high coefficient of conductivity), and is configured into a box form (quadrangular prismatic form). In this instance, the heat releasing member 49 is made as the single integral member. In the heat releasing member 49, the receiving portion 49*a*, which is configured as the recess, has the opening 49*f* on a flange 22 side thereof. More specifically, the opening 49*f* of the heat releasing member 49 opens in the downward direction that is generally parallel to the axis of the hole 3 (the vertical direction, i.e., the top-to-bottom direction of the fuel tank 2) and also opens in the direction generally perpendicular to the axis of the hole 3.

Figure 12:
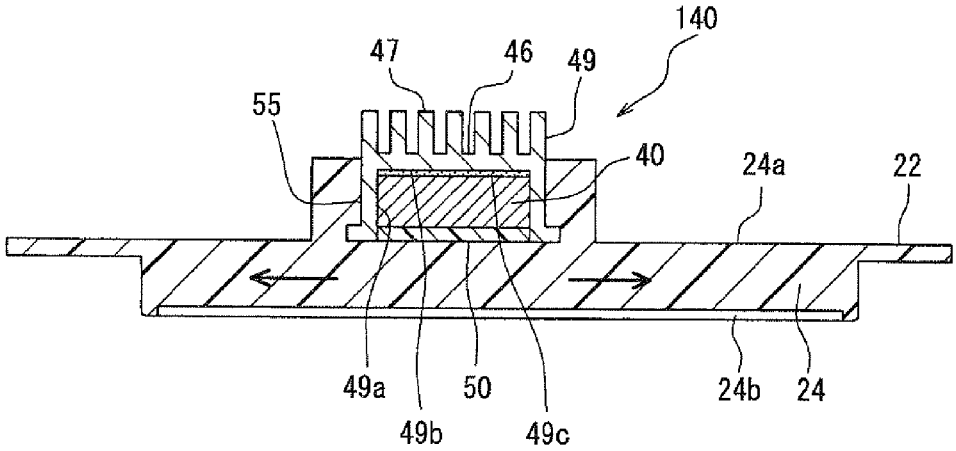
FIG. 12 is a cross sectional view of the flange of the fuel supply apparatus of the second embodiment, being similar to FIG. 7 taken along line VII-VII in FIG. 3.

A size of the opening 49*f* is set to permit insertion of the FPC 40 into the receiving portion 49*a* through the opening 49*f* (see FIGS. 8 and 12). The FPC 40 is fixed to the base part 49*b* of the receiving portion 49*a*, which is located on the side that is opposite from the flange 22 in the direction of the axis of the hole 3, through the bonding agent layer 49*c*, which is made of the silicone bonding agent. In this way, the FPC 40 is received in the receiving portion 49*a* in the contact state thereof where the FPC 40 contacts the base part 49*b* of the receiving portion 49*a*. Furthermore, the terminals 42*a*-42*f* project from the opening 49*f* of the heat releasing member 49 in the direction generally perpendicular to the axis of the hole 3.

As shown in FIGS. 8, 10 and 11, the control device 140 has the protective member 50, which is made of a resin material and is embedded in the flange 22 as follows. Specifically, the protective member 50 fills the remaining space of the receiving portion 49*a*, into which the FPC 40 is received. Also, the protective member 50 covers the connecting portions 44*a*-44*f*. The protective member 50 is entirely embedded in the main body 24 and is held by the main body 24. In the present embodiment, the protective member 50 is made of the resin material of polyphenylene sulfide (PPS) or polyphthalamide (PPA).

The physical property of the resin material (PPS, PPA) of the protective member 50, the physical property of the metal material (aluminum or aluminum alloy) of the heat releasing member 49 and the physical property of the resin material (POM) of the flange 22 will be described briefly below.

The thermal expansion coefficient of the resin material (PPS, PPA) of the protective member 50, the thermal expansion coefficient of the metal material (aluminum or aluminum alloy) of the heat releasing member 49 and the thermal expansion coefficient of the resin material (POM) of the flange 22 differ from one another. Therefore, volumatic thermal expansion coefficients (the coefficients of thermal expansion) of these materials differ from one another. The thermal expansion coefficient of PPS and the thermal expansion coefficient of PPA are smaller than the thermal expansion coefficient of POM but are larger than the thermal expansion coefficient of the electrically conductive metal material of the conductive line members 43*a*-43*f*.

In general, the fuel may be impregnated into a resin material in a greater amount in comparison to a metal material. Therefore, when the fuel is impregnated into the resin material, the volume of the resin material is expanded. This property is known as "fuel swelling". Here, a coefficient of swelling (a swelling coefficient) of the resin material or the metal material is known as a coefficient of volumatic expansion (a volumatic expansion coefficient) of the resin material or the metal material caused by the impregnation of the fuel into the resin material or the metal material. The volumetric expansion coefficient (swelling coefficient) of PPS and the volume expansion coefficient (swelling coefficient) of PPA are smaller than the volume expansion coefficient (swelling coefficient) of POM.

A thermal expansion coefficient of each of PPS and PPA is smaller than a thermal expansion coefficient of POM, which is the material of the flange 22, but is larger than a thermal expansion coefficient of the conductive metal material of each of the terminals 42*a*-42*f* and the conductive line members 43*a*-43*f*. A swelling ratio of a volume of each of PPS and PPA, which is measurable upon immersion thereof in the fuel to enable swell of the material with the fuel penetrating therein, is smaller than that of POM. That is, upon immersion in the fuel, PPS and PPA is less swellable in comparison to POM. The fuel does not penetrate into the conductive metal material upon immersion in the fuel, so that swelling of the conductive metal material does not occur. Both of PPS and PPA are harder and more fragile in comparison to POM. That is, POM is more flexible in comparison to both of PPS and PPA.

A portion (hereinafter, referred to as a planar portion) 50*a* of the protective member 50, which is placed at an outside of the heat releasing member 49, is configured into a planar form (more specifically, a generally flat rectangular parallelepiped form that is elongated in the direction of the row of the terminals 42*a*-42*f*) to cover all of the connecting portions 44*a*-44*f*. Each of the conductive line members 43*a*-43*d* projects from a side surface (lateral surface) 51*a* of the planar portion 50*a* of the protective member 50 located on a side opposite from the FPC 40 in a transverse direction, which is perpendicular to the direction of the row of the terminals 42*a*-42*f*. The side surface 51*a* is elongated, i.e., extends in a direction parallel to the direction of the row of the terminals 42*a*-42*f*. The conductive line member 43*e* projects from a bottom surface 51*d* of the planar portion 50*a* of the protective member 50 located on a side where the inner surface 24*b* of the flange 22 is located (see FIG. 11). The conductive line member 43*f* projects from a side surface (longitudinal end surface) 51*c* of the planar portion 50*a* of the projective member 50, which is adjacent to the terminal 42*f* (see FIG. 8).

The planar portion 50*a* of the protective member 50 is provided with a plurality of anchor portions 52, each of which is formed integrally in a corresponding one of the side surface 51*a*, a side surface (longitudinal end surface) 51*b* and the side surface 51*c* of the planar portion 50*a* of the protective member 50. Each of these side surfaces 51*a*, 51*b*, 51*c* is directed in a corresponding direction that is generally perpendicular to the axis of the hole 3. The anchor portions 52 are provided to increase an anchorage strength between the flange 22 and the FPC 40. In the present embodiment, the anchor portions 52 include five lateral anchor portions 52, which are provided in the side surface 51*a* opposite from the FPC 40, three longitudinal end anchor portions 52, which are provided in the side surface 51*b* on the terminal 42*a* side, and three longitudinal end anchor portions 52, which are provided in the side surface 51*c* on the terminal 42*f* side (see FIG. 8). All of the anchor portions 52 are embedded in the main body 24 of the flange 22.

With reference to FIG. 9, for illustrative purpose, a detail of one of the five lateral anchor portions 52 provided in the side surface 51*a* will now be described. The anchor portion 52 has a first projecting part 52*a* and a second projecting part 52*b*. The first projecting part 52*a* projects from the side surface 51*a* in a direction generally perpendicular to the axis of the hole 3. The second projecting part 52*b* projects from an end of the first projecting part 52*a* in a direction generally parallel to the axis of the hole 3 (and also generally parallel to the side surface 51*a*) such that a gap is provided between the side surface 51*a* and the second projecting part 52*b*. In the present embodiment, the second projecting part 52*b* projects away from the first projecting part 52*a* toward the outer surface 24*a* of the main body 24 of the flange 22. The structure of each of the other remaining anchor portions 52, which are formed in the side surfaces 51*b*, 51*c* of the planar portion 50*a* of the protective member 50, is substantially the same as the structure of the anchor portion 52 described above and is thereby not described redundantly.

The heat releasing member 49 has the outer wall surface 46 at the opposite end part of the heat releasing member 49, which is opposite from the receiving portion 49*a* in the direction of the axis of the hole 3. The outer wall surface 46 of the heat releasing member 49 projects from the outer surface 24*a* of the main body 24 of the flange 22 in the state where the heat releasing member 49 is embedded in the flange 22. Furthermore, the fins 47 are formed integrally on the outer wall surface 46 to project upwardly away from the FPC 40 in the direction generally parallel to the axis of the hole 3.

The heat releasing member 49 has the embeddable portion 56, which is formed at least along a peripheral edge of the opening 49*f* of the receiving portion 49*a* and is adapted to be embedded in the flange 22 (see FIG. 8). A plurality of projections (two projections in this instance) 48 projects from the embeddable portion 56 in a direction generally parallel to the direction of the row of the terminals 42*a*-42*f*. Like in the first embodiment, the projections 48 enhance the anchorage strength of the heat releasing member 49 relative to the main body 24. As shown in FIGS. 10 to 12, when the embeddable portion 56 is embedded in the flange 22, the opening 49*f* of the receiving portion 49*a* is closed with the resin material of the flange 22. Thereby, the FPC 40 and the heat releasing member 49 are fixed to the flange 22, and the interior of the receiving portion 49*a* is isolated from the outside.

The FPC 40, the heat releasing member 49 and the protective member 50 have been described in detail. Next, the flange 22 will be described in detail.

The first connector 26, which is formed in the flange 22, includes the conductive line members 43*a*-43*d* and the first connector housing 26*a*. The second connector 27 includes the conductive line members 43*e*, 43*f* and the second connector housing 27*a*.

As shown in FIG. 10 in view of FIG. 3, the first connector housing 26*a* is integrally formed with the main body 24 such that the first connector housing 26*a* projects upwardly from the outer surface 24*a*. The first connector housing 26*a* is configured into the tubular form such that the first connector housing 26*a* surrounds the conductive line members 43*a*-43*d* while the other end parts of the conductive line members 43*a*-43*d* are exposed to the outside of the first connector housing 26*a* projecting from the outer surface 24*a*. The unexposed sections of the conductive line members 43*a*-43*d* are embedded in the main body 24 through the molding process.

As shown in FIG. 11, the second connector housing 27*a* is integrally formed with the main body 24 such that the second connector housing 27*a* projects downwardly from the inner surface 24*b*. The second connector housing 27*a* is configured into the tubular form such that the second connector housing 27*a* surrounds the conductive line members 43*e*, 43*f* while the other end parts of the conductive line members 43*e*, 43*f* are exposed to the outside of the second connector housing 27*a* that projects from the inner surface 24*b*. The unexposed sections of the conductive line members 43*e*, 43*f* are embedded in the main body 24 through the molding process.

In the present embodiment, the flange 22 serves as the cover member. the FPC 40 serves as the controller. Furthermore, the terminals 42*a*-42*d* serve as first side terminals, and the terminals 42*e*, 42*f* serve as second side terminals. The conductive line members 43*a*-43*d* serve as first side conductive line members, and the connecting portions 44*a*-44*d* serve as connecting portions that connect between the first side terminals and the first side conductive line members. The conductive line members 43*e*, 43*f* serve as second side conductive line members, and the connecting portions 44*e*, 44*f* serve as connecting portions that connect between the second side terminals and the second side conductive line members.

The structure of the flange 22 has been described above. Next, the manufacturing process of the flange 22 will be described in detail.

First of all, the FPC 40 is placed into the receiving portion 49*a* through the opening 49*f* of the heat releasing member 49. Then, the FPC 40 is bonded to the wall surface of the base part 49*b* of the receiving portion 49*a* of the heat releasing member 49 with the silicone bonding agent. Then, the conductive line members 43*a*-43*f* are connected, i.e., are joined to the terminals 41*a*-41*f* of the FPC 40 by, for example, welding. As shown in FIG. 8, the conductive line members 43*a*-43*f* are bent in the appropriate manner, so that upon placement of the conductive line members 43*a*-43*f* on the flange 22, the other end parts of the conductive line members 43*a*-43*d* are placed in the first connector housing 26*a*, and the other end parts of the conductive line members 43*e*, 43*f* are placed in the second connector housing 27*a*.

Next, the FPC 40 is fixed to the heat releasing member 49, and the conductive line members 43*a*-43*f* are electrically connected to the terminals 42*a*-42*f*, respectively, to form an assembly. Then, this assembly is placed in a molding die to form the protective member 50 on the assembly through molding. Thereafter, the molten resin material, which forms the protective member 50, is filled in the molding die. In this way, there is formed an intermediate molded product, in which the protective member 50 is molded to cover the connecting portions 44*a*-44*f*.

In the present embodiment, the flange 22 is manufactured by insert-molding of the intermediate molded product in the flange 22. Specifically, the intermediate molded product is placed in a molding die, which is adapted to mold the main body 24, the fuel supply pipe 25, the first connector housing 26*a* and the second connector housing 27*a*, and the molten resin material is filled in a cavity of the molding die. In this way, there is formed the flange 22, in which the embeddable portion 56 of the heat releasing member 49, the protective member 50, the FPC 40 and the portions of the conductive line members 43*a*-43*f* are embedded in the main body 24 of the flange 22.

The structure of the flange 22 has been described in detail above. Next, the operation of the fuel supply apparatus 6 will be described in detail.

The FPC 40 receives the command signal from the ECU 9. The FPC 40 controls the electric power to be supplied to the fuel pump 34 according to the command signal. The fuel pump 34 is driven in response to the supplied electric power (the supplied amount of electric current) to draw the fuel, which is filtered through the suction filter 35, and to discharge the drawn fuel toward the fuel filter 36 upon pressurizing the drawn fuel. The discharged fuel is filtered through the fuel filter 36 and is conducted toward the pressure regulator 39. The pressure regulator 39 adjusts, i.e., regulates the pressure of the fuel and outputs the pressure-regulated fuel toward the fuel hose 28. The pressure-regulated fuel is supplied to the internal combustion engine 10 through the fuel hose 28, the fuel supply pipe 25, the fuel supply conduit line 12, the delivery pipe 7 and the fuel injection valve 8.

Here, the FPC 40 generates heat when the FPC 40 controls the electric power supplied to the fuel pump 34. This heat is conducted to the base part 49*b* of the receiving portion 49*a* of the heat releasing member 49 through the bonding agent layer 49*c*. Thereafter, the heat is conducted to the fins 47, which are formed at the outer wall surface 46. The heat, which is conducted to the fins 47 at the outside of the fuel tank 2, undergoes a heat exchange with the air located outside of the fuel tank 2, thereby being released to the surrounding atmosphere.

The heat, which is generated at the FPC 40, is also conducted to the flange 22 through the heat releasing member 49, the protective member 50, the terminals 42*a*-42*f* and the conductive line members 43*a*-43*f*. The heat, which is conducted to the flange 22, causes an increase in the temperature of the main body 24, so that the main body 24 is expanded. In the present embodiment, the size of the flange 22 in the radial direction thereof is larger than the size of the flange 22 in the thickness direction thereof (the direction generally parallel to the axis of the hole 3). Therefore, a difference between the size of the flange 22 in the radial direction thereof before the thermal expansion and the size of the flange 22 in the radial direction thereof after the thermal expansion becomes larger than a difference between the size of the flange 22 in the thickness direction thereof before the thermal expansion and the size of the flange 22 in the thickness direction thereof after the thermal expansion. That is, the main body 24 is expanded in the radial direction in the greater amount in comparison to the amount of expansion of the main body 24 in the thickness direction (see FIGS. 10, 11 and 12).

When the flange 22 is expanded in the above-described manner, the conductive line members 43*a*-43*f* may be pulled in the radial direction of the flange 22 by the thermally expanding POM and may possibly be pulled in a direction away from the terminals 42*a*-42*f*. When the pulling direction of any of the conductive line members 43*a*-43*f* coincides with a direction of a plane of a connection surface, at which the conductive line member 43*a*-43*f* is connected to the corresponding terminal 42*a*-42*f* through the corresponding connecting portion 44*a*-44*f*, a shearing stress is applied to the surface of the connecting portion 44*a*-44*f*. The connecting portion 44*a*-44*f* is more fragile than the terminal 42*a*-42*f* and a main body of the conductive line member 43*a*-43*f*, so that the shearing stress is likely applied to, i.e., is likely concentrated to the connecting portion 44*a*-44*f*. When the shearing stress, which is applied to the connecting portion 44*a*-44*f*, becomes larger than a proof stress of the connecting portion 44*a*-44*f*, a connecting state of the connecting portion 44*a*-44*f* is deteriorated, so that the conductive line member 43*a*-43*f* and the corresponding terminal 42*a*-42*f* may be disconnected from each other.

In contrast, according to the present embodiment, the protective member 50, which covers the connecting portions 44*a*-44*f*, is embedded in the flange 22. Therefore, even when the conductive line member 43*a*-43*f* is pulled away from the corresponding terminal 42*a*-42*f* due to the thermal expansion of POM, it is possible to limit the application of the stress to the connecting portion 44*a*-44*f*.

Furthermore, as described above, the thermal expansion coefficient of the material of the protective member 50 is smaller than the thermal expansion coefficient of POM. Therefore, even when the protective member 50 is thermally expanded, the stress, which is applied to the connecting portion 44*a*-44*f*, can be reduced in comparison to the case where the connecting portion 44*a*-44*f* directly contacts POM.

As discussed above, when the flange 22 has the protective member 50, the stress applied to the connecting portion 44*a*-44*f* can be reduced in comparison to the previously proposed one. Thereby, the deterioration of the electrical connection at the connecting portion 44*a*-44*f* between the terminal 42*a*-42*f* and the conductive line member 43*a*-43*f* can be limited.

The fuel, which is stored in the fuel tank 2, tends to be vaporized, so that the fuel vapor fills the inside of the fuel tank 2. The fuel vapor, which is vaporized in the fuel tank 2, contacts the flange 22, which covers the hole 3 of the fuel tank 2. Particularly, in the present embodiment, the flange 22 is made of POM, so that the flange 22 may be swelled with the fuel. The flange 22 may be also expanded by the heat, which is generated at the FPC 40. The swelling caused by the fuel is a phenomenon, which tends to occur in the resin material due the permeation (penetration) of the fuel into the resin material and does not normally occur in the metal material due to the fact that the fuel does not substantially permeate into the metal material. Therefore, the swelling induced by the fuel permeation may also causes a difference between the amount of expansion of the resin material and the amount of expansion of the metal material. Thus, similar to the case of the thermal expansion of the flange 22, the terminals 42*a*-42*f* and the conductive line members 43*a*-43*f*, the electrical connections at the connecting portions 44*a*-44*f* may possibly be deteriorated by the swelling induced by the fuel permeation.

In the present embodiment, as discussed above, the resin material of the protective member 50 is one of PPS and PPA. Therefore, even when the fuel-induced swelling of the resin material occurs, it is possible to reduce the stress, which is applied to the connecting portions 44*a*-44*f* like in the case of the thermal expansion.

As discussed above, the connecting portions 44*a*-44*f* are covered with the protective member 50 to protect the connecting portions 44*a*-44*f*. However, the thermal expansion coefficient of the resin material of the protective member 50 is smaller than the thermal expansion coefficient of the resin material of the flange 22. Therefore, when the flange 22 is thermally expanded, a gap may be formed between the protective member 50 and the flange 22 due to a difference between an amount of thermal expansion of the protective member 50 and an amount of thermal expansion of the flange 22. When the gap is formed between the protective member 50 and the flange 22, the anchorage strength of the protective member 50 relative to the flange 22 may possibly be deteriorated.

However, according to the present embodiment, the protective member 50 has the anchor portions 52, which are embedded in the flange 22, so that it is possible to limit or minimize the formation of the gap between the protective member 50 and the flange 22. As discussed above, each anchor portion 52 has the first projecting part 52*a*, which projects from the corresponding side surface 51*a*, 51*b*, 51*c* of the protective member 50, and the second projecting part 52*b*, which projects from the end of the first projecting part 52*a* along the side surface 51*a*, 51*b*, 51*c* of the protective member 50 in the direction generally parallel to the axis of the hole 3 such that the gap is provided between the side surface 51*a*, 51*b*, 51*c* of the protective member 50 and the second projecting part 52*b*. Therefore, when the anchor portions 52 are embedded in the flange 22, the resin material is filled in the gap between each second projecting part 52*b* and the opposed side surface 51*a*, 51*b*, 51*c* of the protective member 50.

Thus, when both of the flange 22 and the protective member 50 are thermally expanded such that the resin material of the flange 22 is pulled away from the side surface 51*a*, 51*b*, 51*c* of the protective member 50, the second projecting parts 52*b* limit movement of the resin material of the flange 22, which is held between the second projecting parts 52*b* and the side surface 51*a*, 51*b*, 51*c* of the protective member 50. The anchor portions 52 function in the above described manner, so that it is possible to limit the formation of the gap between the protective member 50 and the flange 22. Thereby, the reduction in the anchorage strength of the protective member 50 relative to the flange 22 can be limited.

Furthermore, as discussed above, the flange 22 expands in the greater amount in the radial direction thereof. Therefore, the gap, which is generated between the corresponding one of the side surfaces 51*a*, 51*b*, 51*c* of the protective member 50 and the flange 22, may possibly become larger than the gap, which is generated between the flange 22 and one of the top surface and the bottom surface 51*d* of the planar portion 50*a* of the protective member 50, which are opposed to each other in the direction of the axis of the hole 3 (the thickness direction of the flange 22).

In the present embodiment, the anchor portions 52 are formed in the side surfaces 51*a*, 51*b*, 51*c* of the protective member 50, so that the generation of the gap between the flange 22 and each of the side surfaces 51*a*, 51*b*, 51*c* of the protective member 50 can be effectively limited. The phenomenon of the expansion of the flange 22 in the radial direction also occurs in the case of the fuel-induced swelling of the flange 22. The anchor portions 52 of the present embodiment can limit the generation of the gap between the flange 22 and each of the side surfaces 51*a*, 51*b*, 51*c* of the protective member 50 even in the case of occurrence of the fuel-induced swelling, like in the case of the thermal expansion.

As described above, the tank walls of the fuel tank 2 may be flexed according to the pressure in the inside of the fuel tank 2. Therefore, it is desirable that the flange 22 can follow the movement, i.e., the displacement of the tank wall of the fuel tank 2. In the present embodiment, the flange 22 is made of POM, which has the higher flexibility in comparison to the material of the protective member 50, so that the flange 22 can follow the movement of the tank wall of the fuel tank 2.

Third Embodiment

Now, a third embodiment of the present invention will be described with reference to FIGS. 13 to 17 in view of FIGS. 1 to 3. The third embodiment is a modification of the second embodiment.

Figure 13:
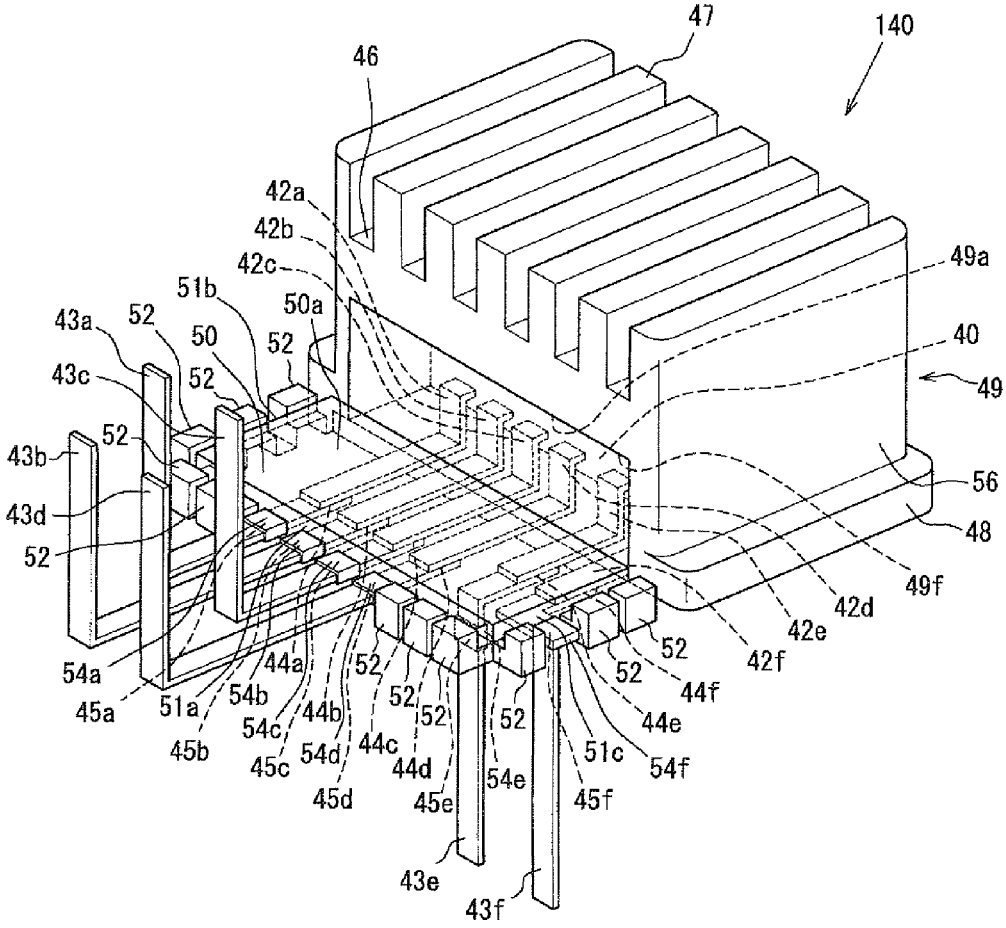
FIG. 13 is a perspective view showing a control device of a fuel supply apparatus according to a third embodiment of the present invention.
Figure 14:
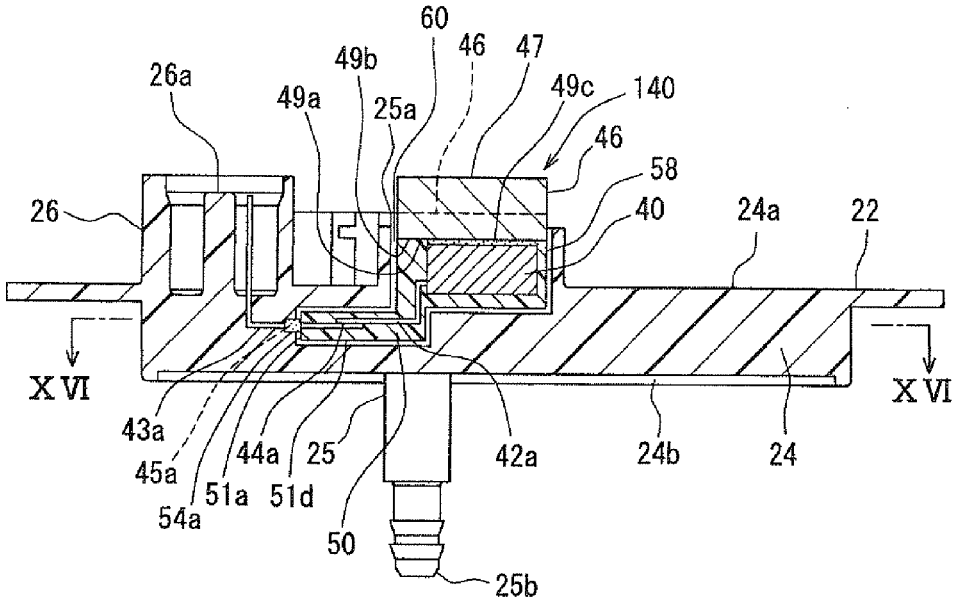
FIG. 14 is a cross sectional view of a flange of the fuel supply apparatus of the third embodiment, being similar to FIG. 5 taken along line V-V in FIG. 3.
Figure 15:
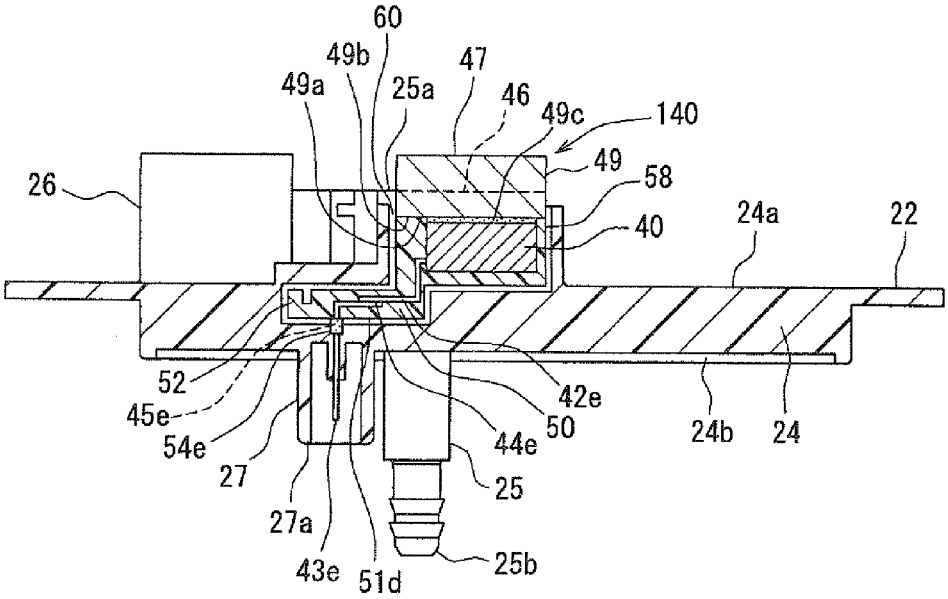
FIG. 15 is another cross sectional view of the flange of the fuel supply apparatus of the third embodiment, being similar to FIG. 6 taken along line VI-VI in FIG. 3.
Figure 16:
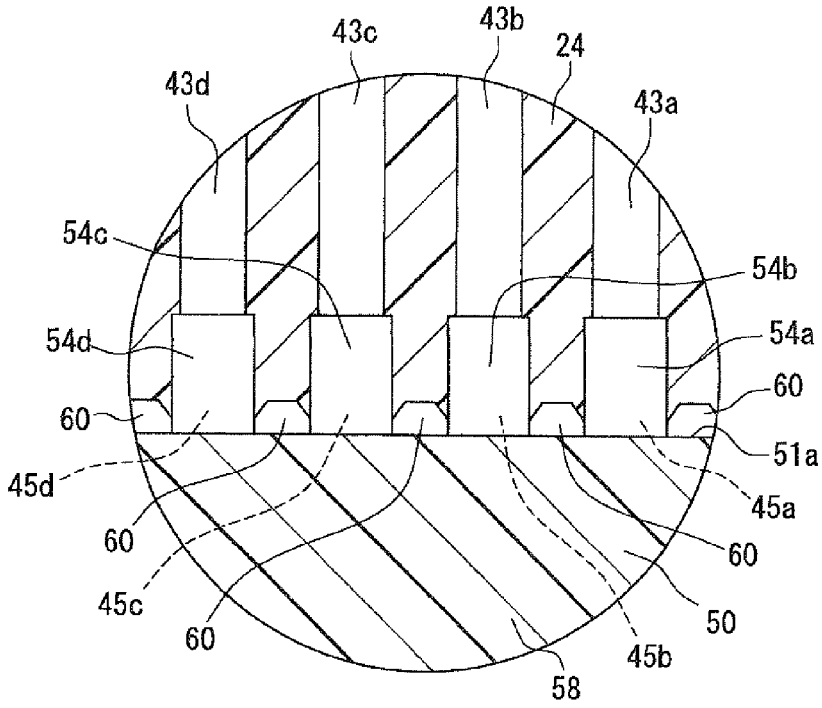
FIG. 16 is an enlarged cross sectional view taken along line XVI-XVI in FIG. 14.

Similar to the second embodiment, the control device 140 includes the FPC 40, the heat releasing member 49 and the protective member 50. The heat releasing member 49 receives the FPC 40. The protective member 50 is made of a resin material and protects connecting portions 44*a*-44*f*, each of which connects between the corresponding one of terminals 42*a*-42*f* of the FPC 40 and the corresponding one of the conductive line members 43*a*-43*f*. As shown in FIGS. 13 to 15, a portion of each of the conductive line members 43*a*-43*f* is embedded in the protective member 50, and the rest of the conductive line member 43*a*-43*f* projects from the protective member 50. The control device 140 and the conductive line members 43*a*-43*f* are embedded in the main body 24 such that the corresponding portions of the control device 140 and of the conductive line members 43*a*-43*f* are exposed from the main body 24. With reference to FIGS. 14 to 16, a portion of the control device 140, which contacts the main body 24 and is held by, i.e., is anchored to the main body 24 in the final product of the fuel supply apparatus 6, will be referred to as a holding portion (anchoring portion) 58. The holding portion 58 may be considered as an outer surface of the anchored portion of the control device 140, which is anchored in the main body 24.

The control device 140 includes the holding portion 58, which is embedded in the main body 24. When the holding portion 58 is embedded in the main body 24, the control device 140 is held by the flange 22. In the present embodiment, the holding portion 58 includes the remaining portion of the heat releasing member 49 (i.e., the portion of the heat releasing member 49 other than the fins 47) and the surfaces of the protective member 50 (see FIGS. 5 and 6 in view of FIG. 2).

Furthermore, similar to the control device 140, the conductive line members 43*a*-43*f* are embedded in the main body 24 such that the other end part of each of the conductive line members 43*a*-43*f* is exposed from the outer surface 24*a* or the inner surface 24*b*.

Next, characteristic features to the present embodiment will be described. As shown in FIGS. 13 to 15, a coating of primer agent (hereinafter, referred to as a primer agent coating) 54*a*-54*f* is applied to each of root parts 45*a*-45*d* of the conductive line members 43*a*-43*d*, which extend from the protective member 50 (more specifically, the planar portion 50*a* of the protective member 50). Specifically, the primer agent coatings 54*a*-54*d* are applied to the root parts 45*a*-45*d*, respectively, of the conductive line members 43*a*-43*d*, which are exposed from the side surface 51*a* of the protective member 50, to bond between the side surface 51*a* of the protective member 50 and the main body 24. Each of the primer agent coatings 54*a*-54*d* covers all around the root part 45*a*-45*d* of the corresponding one of the conductive line members 43*a*-43*d*.

The primer agent coating 54*e* is applied to the root part 45*e* of the conductive line member 43*e* all around the root part 45*e* to bond between the bottom surface 51*d* of the protective member 50 and the main body 24. The primer agent coating 54*f* is applied to the root part 45*f* of the conductive line member 43*f* all around the root part 45*f* to bond between the side surface 51*c* of the protective member 50 and the main body 24.

In the present embodiment, the primer agent of the primer agent coating 54*a*-54*f* is a bonding agent, which is prepared by dissolving epichlorohydrin rubber in solvent, such as toluene solvent or xylene solvent. Besides the bonding property, the epichlorohydrin rubber has a flame-resistant property and a waterproof property. Therefore, when the epichlorohydrin rubber is included in the bonding agent, the bonding agent can have the flame-resistant property and the waterproof property.

Next, the operation of the fuel supply apparatus 6 will be described together with the functions and advantages of the flange 22, on which the control device 140 and the conductive line members 43*a*-43*f* are installed.

The FPC 40 receives the command signal from the ECU 9. The FPC 40 controls the electric power to be supplied to the fuel pump 34 according to the command signal. The fuel pump 34 is driven in response to the supplied electric power (the supplied amount of electric current) to draw the fuel, which is filtered through the suction filter 35, and to discharge the drawn fuel toward the fuel filter 36 upon pressurizing the drawn fuel. The discharged fuel is filtered through the fuel filter 36 and is conducted toward the pressure regulator 39. The pressure regulator 39 adjusts, i.e., regulates the pressure of the fuel and outputs the pressure-regulated fuel toward the fuel hose 28. The pressure-regulated fuel is supplied to the internal combustion engine 10 through the fuel hose 28, the fuel supply pipe 25, the fuel supply conduit line 12, the delivery pipe 7 and the fuel injection valve 8.

Here, the FPC 40 generates heat when the FPC 40 controls the electric power supplied to the fuel pump 34. This heat is conducted to the base part 49*b* of the receiving portion 49*a* of the heat releasing member 49 through the bonding agent layer 49*c*. Thereafter, the heat is conducted to the fins 47, which are formed at the outer wall surface 46. The heat, which is conducted to the fins 47 at the outside of the fuel tank 2, undergoes a heat exchange with the air located outside of the fuel tank 2, thereby being released to the surrounding atmosphere.

The heat, which is generated at the FPC 40, is also conducted to the flange 22 through the heat releasing member 49, the protective member 50, the terminals 42*a*-42*f* and the conductive line members 43*a*-43*f*. Thereby, each of the heat releasing member 49, the protective member 50 and the main body 24 is expanded in conformity with the thermal expansion coefficient thereof. In addition, the protective member 50 and the main body 24 are also expanded by the action of the fuel swelling when the fuel vapor in the fuel tank 2 is impregnated into the protective member 50 and the main body 24.

In the present embodiment, the connecting portions 44*a*-44*f* are covered with the protective member 50, which has the smaller thermal expansion coefficient and the smaller swelling coefficient for the fuel in comparison to the those of the main body 24. Therefore, even when the main body 24 is expanded due to the temperature change caused by the heat generated from the FPC 40 and the impregnation of the fuel into the main body 24 and the protective member 50, it is possible to reduce or minimize the stress applied to the connecting portions 44*a*-44*f*. As a result, it is possible to limit the deterioration of the electrical connection state of the respective connecting portions 44*a*-44*f*.

However, although the protective member 50 can limit the deterioration of the electrical connection state of the respective connecting portions 44*a*-44*f*, there remains a possibility of forming small gaps 60, which can conduct water, between the holding portion 58 of the control device 140 and the main body 24 upon long time use of the fuel supply apparatus 6 due to differences in the thermal expansion coefficient and the swelling coefficient for the fuel among the resin material (PPS, PPA) of the protective member 50, the metal material (aluminum or aluminum alloy) of the heat releasing member 49 and the resin material (POM) of the flange 22, as shown in FIGS. 14 and 15.

The protective member 50 has the anchor portions 52, which improve the anchorage strength between the protective member 50 and the main body 24. However, the material of the protective member 50, the material of the heat releasing member 49 and the material of the main body 24 respectively show the different coefficients of thermal expansion and the different coefficients of swelling with the fuel, as discussed above. Therefore, it is difficult to eliminate the formation of the gaps 60.

As shown in FIGS. 14 and 15, the gap 60 may be formed along the holding portion 58. Therefore, the projecting parts of the conductive line members 43*a*-43*f*, which project from the protective member 50, may possibly be communicated with the outside of the flange 22 through the gap 60.

Figure 17:
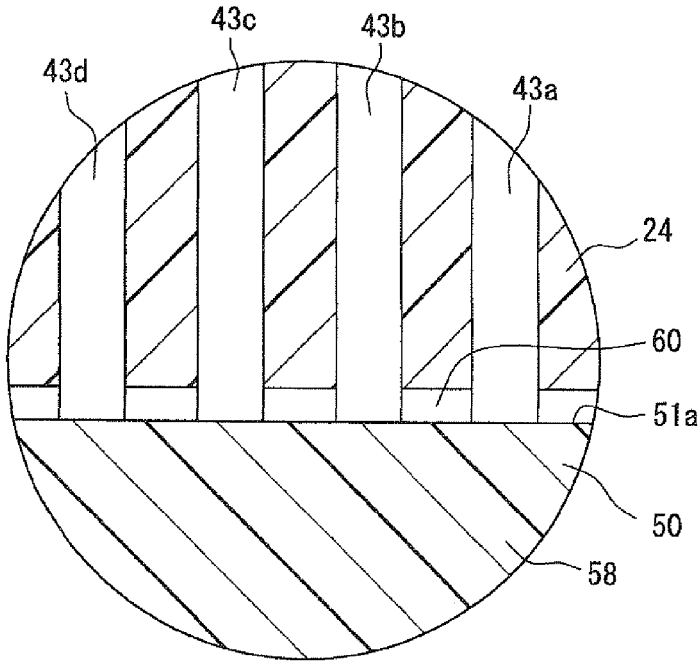
FIG. 17 is a view similar to FIG. 16 showing a comparative case where primer agent coatings are not applied to conductive line members.

FIG. 17 is a view similar to FIG. 16 taken along ling XVI-XVI in FIG. 14 but is different from FIG. 16 as follows. Specifically, in the case of FIG. 17, the primer agent coatings 54*a*-54*f* are not applied to the conductive line members 43*a*-43*f* like in the second embodiment. As shown in FIG. 17, the gap 60 may possibly be formed between the holding portion 58 of the control device 140 and the main body 24 of the flange 22 due to the expansion of the material of the holding portion 58 (more specifically, the expansion of the material of the protective member 50) at its corresponding expansion coefficient and the expansion of the material of the main body 24 at its corresponding expansion coefficient upon occurrence of the temperature change and/or the fuel swelling. When the gap 60 is formed between the holding portion 58 (more specifically, the protective member 50) and the main body 24, water may be conducted through the gap 60. The water conducted to the conductive line members 43*a*-43*f* may possibly cause the short circuiting between the conductive line members 43*a*-43*f*. In this state, when the fuel supply apparatus 6 is operated to apply the voltage to the conductive line members 43*a*-43*f*, galvanic corrosion may occur at the conductive line members 43*a*-43*f*. Thereby, the reliability of the fuel supply apparatus 6 may be deteriorated.

In contrast, according to the present embodiment, as shown in FIG. 16, the primer agent, which forms the primer agent coating 54*a*-54*f*, is applied to the root part 45*a*-45*f* of each of the conductive line members 43*a*-43*f*. Therefore, even the temperature change and/or the fuel swelling occur to induce the generation of the gap 60 between the holding portion 58 (more specifically, the protective member 50) and the main body 24, the gap 60 may not be formed around the area where the primer agent is applied due to the advantageous bonding property of the primer agent coatings 54*a*-54*f*. In this way, it is possible to limit the communication between the conductive line members 43*a*-43*f* through the gap 60. Thus, even when the water enters into the gap 60 thorough its opening, the short circuiting between the conductive line members 43*a*-43*f* through the water can be limited. In this way, the occurrence of the galvanic corrosion can be limited, and thereby it is possible to limit the deterioration of the reliability of the fuel supply apparatus 6.

Furthermore, even when the gap 60 is formed around the primer agent coatings 54*a*-54*f*, the water, which enters into the gap 60, does not directly contact the conductive line members 43*a*-43*f* because of the presence of the primer agent coatings 54*a*-54*f* therearound. Thereby, it is possible to limit the occurrence of the short circuiting between the conductive line members 43*a*-43*f* through the water. Furthermore, the primer agent coatings 54*a*-54*f* have the waterproof property. Thereby, it is possible to limit the contact of the water to the conductive line members 43*a*-43*f*.

As shown in FIG. 15, the conductive line members 43*e*, 43*f* are provided in the second connector 27, which is placed in the inside of the fuel tank 2. The remaining space of the inside of the fuel tank 2, which is not filled with the liquid fuel, is filled with the fuel vapor. Therefore, the greater amount of fuel vapor is applied to the second connector housing 27*a* to penetrate the same in comparison to the first connector housing 26*a*. Particularly, the fuel vapor tends to penetrate into the boundary between the second connector housing 27*a* and the conductive line member 43*e*, 43*f*. The fuel vapor, which enters into the boundary between the second connector housing 27*a* and the conductive line member 43*e*, 43*f* may be conducted upwardly along the surface of the conductive line member 43*e*, 43*f*. The fuel vapor, which is conducted along the surface of the conductive line member 43*e*, 43*f* in this manner, may reach the gap 60 and may be released to the outside of the flange 22.

According to the present embodiment, the primer agent coating 54*e*, 54*f* is also formed at each of the conductive line members 43*e*, 43*f*. Thus, the fuel vapor, which is conducted upwardly along the surface of the conductive line members 43*e*, 43*f*, can be blocked with the primer agent coating 54*e*, 54*f*. Thereby, it is possible to limit the release of the fuel vapor to the outside through the flange 22.

In the present embodiment, the flange 22 serves as a cover member of the present invention. The FPC 40 serves as a controller of the present invention. The conductive line members 43*a*-43*f* serve as conductive line members of the present invention.

Next, the manufacturing process of the flange 22, on which the control device 140 is installed, will be described. First of all, the FPC 40 is placed into the receiving portion 49*a* through the opening 49*f* of the heat releasing member 49. Then, the FPC 40 is bonded to the wall surface of the base part 49*b* of the receiving portion 49*a* of the heat releasing member 49 with the silicone bonding agent. Then, the conductive line members 43*a*-43*f* are connected, i.e., are joined to the terminals 42*a*-42*f* of the FPC 40 by, for example, welding. As shown in FIG. 13, the conductive line members 43*a*-43*f* are bent in the appropriate manner, so that upon placement of the conductive line members 43*a*-43*f* on the flange 22, the other end parts of the conductive line members 43*a*-43*d* are placed in the first connector housing 26*a*, and the other end parts of the conductive line members 43*e*, 43*f* are placed in the second connector housing 27*a*.

The FPC 40 is fixed to the heat releasing member 49, and the conductive line members 43*a*-43*f* are electrically connected to the terminals 42*a*-42*f*, respectively, to form an assembly. Then, this assembly is placed in a molding die to form the protective member 50 on the assembly through molding. Thereafter, the molten resin material, which forms the protective member 50, is filled in the molding die. In this way, there is formed an intermediate molded product, in which the protective member 50 is molded to cover the connecting portions 44*a*-44*f*.

Then, the primer agent is applied to the root parts 45*a*-45*f* of the conductive line members 43*a*-43*f*, which project from the protective member 50 of the control device 140, through an application apparatus, which applies the primer agent by, for example, spraying or brushing, so that the primer agent coatings 54*a*-54*f* are formed at the root parts 45*a*-45*f*. Then, the primer agent coatings 54*a*-54*f* are dried at a drying step.

Thereafter, the thus produced intermediate molded product is insert molded in the flange 22 in an insert molding step.

In the insert molding step, the intermediate molded product is placed in a molding die, which is adapted to mold the main body 24, the fuel supply pipe 25, the first connector housing 26*a* and the second connector housing 27*a*, and the molten resin material is filled in a cavity of the molding die. In this way, like in the case of the first embodiment shown in FIG. 3, there is formed the flange 22, on which the control device 140 and the conductive line members 43*a*-43*f* are installed. At the time of the insert molding, the molten POM is filled into the molding die at a predetermined pressure. Therefore, the bonding strength between the holding portion 58 of the control device 140 and the main body 24 of the flange 22 through the primer agent coatings 54*a*-54*f* can be improved.

Furthermore, in the present embodiment, PPS or PPA, which has the melting point higher than that of POM, is used as the resin material of the protective member 50. Thus, at the time of insert molding, the surface of solidified PPS or PPA does not melt even upon the application of the molten POM to the surface of solidified PPS or PPA. Thus, the heat seal of POM to PPS or PPA is not likely to occur. The melting point of POM is about 165 degree Celsius, and the melting point of PPS or PPA is equal to or higher than 200 degrees Celsius. As discussed above, in the case where the melting point of the resin material, which surrounds the intermediate molded product, is higher than that of the intermediate molded product, the heat seal between them is not likely to occur, thereby resulting in the relatively weak bonding strength therebetween. Therefore, there is a high possibility of forming the gap 60 between the holding portion 58 of the control device 140 and the main body 24.

Thus, the primer agent coatings 54*a*-54*f*, which are applied to the root parts 45*a*-45*f* of the conductive line members 43*a*-43*f* and bond between the holding portion 58 and the main body 24, are particularly effective and advantageous in the case where the heat seal between the holding portion 58 and the main body 24 cannot be expected, and thereby the gap 60 is likely formed therebetween.

Fourth Embodiment

Figure 18:
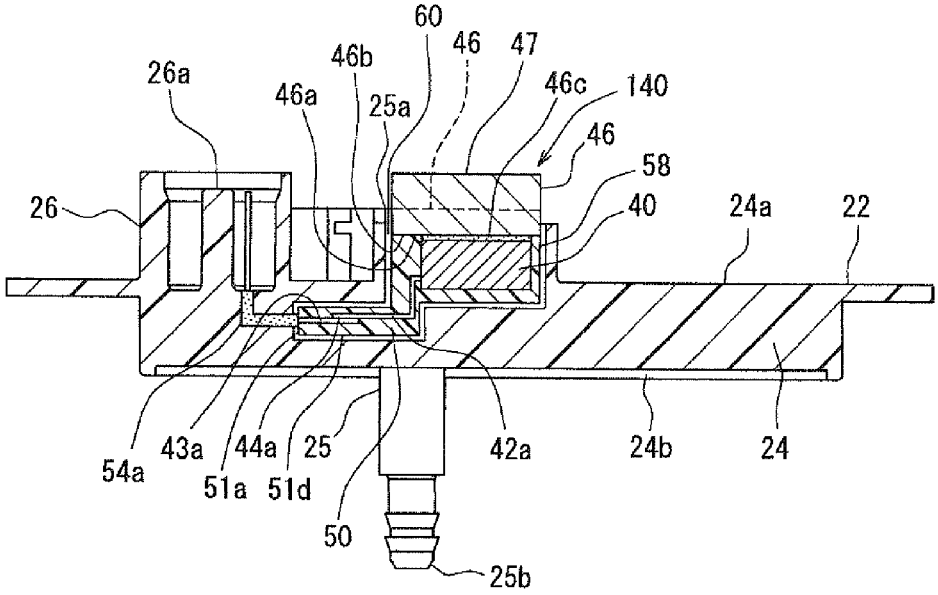
FIG. 18 is a cross sectional view of a flange of the fuel supply apparatus according to a fourth embodiment of the present invention, being similar to FIG. 5 taken along line V-V in FIG. 3.

Now, a fourth embodiment of the present invention will be described with reference to FIG. 18. The fourth embodiment is a modification of the third embodiment. FIG. 18 is a cross-sectional view similar to FIG. 5 taken along line V-V in FIG. 3. In the fourth embodiment, rather than applying the primer agent coatings 54*a*-54*f* to the root parts 45*a*-45*f* of the conductive line members 43*a*-43*f*, the primer agent coatings 54*a*-54*f* are applied to the entire embedded portions of the conductive line members 43*a*-43*f*, which are embedded in the main body 24. When the primer agent coatings 54*a*-54*f* are applied to the entire embedded portions of the conductive line members 43*a*-43*f*, the short circuiting between the conductive line members 43*a*-43*f* through the water or the like can be more reliably limited in comparison to the third embodiment.

Fifth Embodiment

Figure 19:
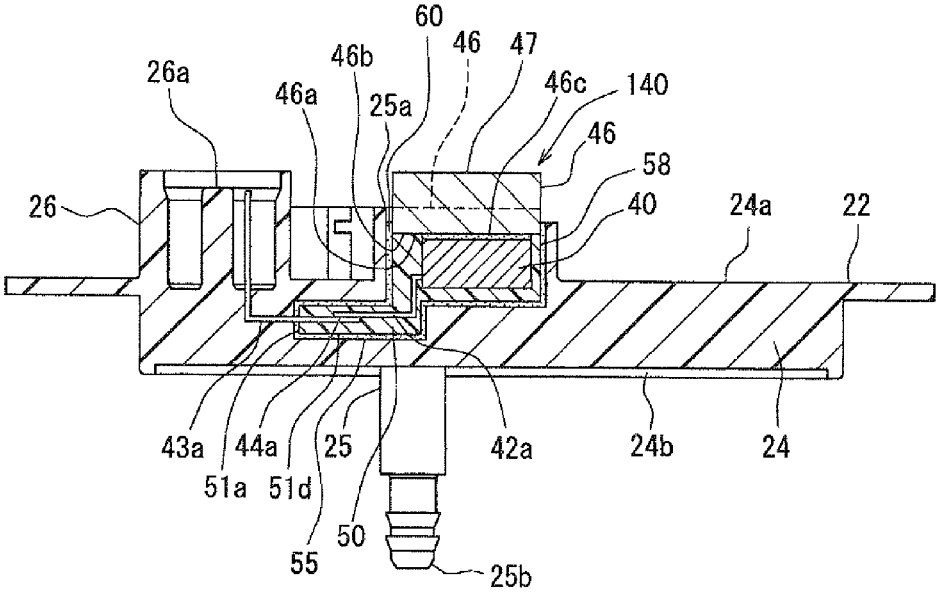
FIG. 19 is a cross sectional view of a flange of the fuel supply apparatus according to a fifth embodiment of the present invention, being similar to FIG. 5 taken along line V-V in FIG. 3.

Now, a fifth embodiment of the present invention will be described with reference to FIG. 19. The fifth embodiment is a modification of the third or fourth embodiment. FIG. 19 is a cross-sectional view similar to FIG. 5 taken along line V-V in FIG. 3. Unlike the third and fourth embodiments, a primer agent coating 55 is applied to the outer surface of the entire holding portion 58 of the control device 140.

When the primer agent coating 55 is applied to the entire holding portion 58, the fluid communication between the conductive line members 43*a*-43*f* and the outside of the flange 22 through the gap 60 can be further effectively limited. Even in this way, it is possible to limit the occurrence of the short circuiting between the conductive line members 43*a*-43*f* with the water.

Alternatively, rather than coating the entire holding portion 58 with the primer agent coating 55, the primer agent coating 55 may be partially applied to outer surface of the holding portion 58 such that the primer agent coating 55 covers only an outer surface of a segment of the holding portion 58 all around thereof (i.e., 360 degrees all around the segment of the holding portion 58). Even in the case where the gap 60 is formed between an uncoated area of the holding portion 58, which is not coated with the primer agent coating 55, and the main body 24, when the water enters into the thus formed gap 60, the primer agent coating 55, which is placed all around the segment of the holding portion 58, can limit further penetration of the water toward the conductive line members 43*a*-43*f*. Therefore, the short circuiting between the conductive line members 43*a*-43*f* with the water can be effectively limited.

The various embodiments of the present invention have been described. The present invention is not limited to the above embodiments, and the above embodiments may be modified within the spirit and scope of the present invention.

For instance, with respect to the third to fifth embodiments, the primer agent coatings 54*a*-54*f*, 55 are not need to be applied to only the conductive line members 43*a*-43*f* (the first and second embodiments) or only to the holding portion 58 of the control device 140 (the third embodiment), and the primer agent coatings 54*a*-54*f*, 55 may be applied to both of them in some cases.

Furthermore, it should be noted that any one or more of the above limitations (features) of any one or more of the fuel supply apparatuses discussed in the above embodiments (first to fifth embodiments) may be combined with any one or more of the above limitations (features) of another one or more of the fuel supply apparatus discussed in the above embodiments (first to fifth embodiments) to implement a desired fuel supply apparatus, if desired. For instance, the primer agent coating(s) 54*a*-54*f*, 55 may be used in the first embodiment. As an example, the primer agent coatings, which are similar to the primer agent coatings 54*a*-54*f* of the fourth embodiment, may be applied to the terminals 41*a*-41*d* and the conductive line members 43*a*-43*f* of the first embodiment after the welding between each of the terminals 41*a*-41*d* and the corresponding one of the conductive line members 43*a*-43*f* and the forming of the resin portion 49*d*. Also, the heat releasing member 49 of the first embodiment, which includes the projections 48 having the first and second projecting parts 48*a*, 48*b*, may be used in any one of the second to fifth embodiments.

Additional advantages and modifications will readily occur to those skilled in the art. The invention in its broader terms is therefore not limited to the specific details, representative apparatus, and illustrative examples shown and described.

What is claimed is:

1. A fuel supply apparatus that is adapted to supply fuel, which is received in a fuel tank, to a fuel consuming apparatus located at an outside of the fuel tank, the fuel supply apparatus comprising:

a cover member that covers a hole formed in the fuel tank, wherein the cover member is made of a resin material;

an electric fuel pump that is placed in an inside of the fuel tank, wherein the electric fuel pump draws the fuel received in the fuel tank and discharges the drawn fuel upon pressurizing the drawn fuel when an electric power is supplied to the electric fuel pump;

a controller that is installed to the cover member and controls the electric power, which is supplied to the electric fuel pump; and a heat releasing member that is adapted to release heat generated from the controller and is made of a metal material, which has a heat conductivity that is higher than a heat conductivity of the resin material of the cover member, wherein the heat releasing member includes:

a receiving portion that holds the controller, which is installed to the receiving portion through an opening of the receiving portion and contacts an inner wall surface of the receiving portion; and an embeddable portion, which is formed at least along a peripheral edge of the opening of the receiving portion and is embedded in the cover member, wherein:

the opening of the receiving portion opens on a side where the inside of the fuel tank is located;

the opening of the receiving portion is closed with the cover member;

an outer wall surface of the heat releasing member is located on a side of the receiving portion, which is opposite from the opening of the receiving portion; and the outer wall surface of the heat releasing member projects outwardly in a direction away from the inside of the fuel tank from an outer surface of the cover member, which faces the outside of the fuel tank.

2. The fuel supply apparatus according to claim 1, wherein the heat releasing member includes at least one projection, which projects outwardly from the embeddable portion and is embedded in the cover member.

3. The fuel supply apparatus according to claim 2, wherein each of the at least one projection has:

a first projecting part, which projects from the embeddable portion in a direction generally perpendicular to an axis of the hole of the fuel tank; and a second projecting part, which projects from the first projecting part in a direction generally parallel to the axis of the hole of the fuel tank such that a gap is formed between the embeddable portion and the second projecting part.

4. The fuel supply apparatus according to claim 1, wherein:

the resin material of the cover member is dielectric;

the cover member includes:

a first connector that has a first housing, which receives at least one first side conductive line member that is adapted to electrically connect between the controller and an external device; and a second connector that has a second housing, which receives at least one second side conductive line member that electrically connects between the controller and the electric fuel pump;

the first housing and the second housing are formed integrally in the cover member;

each of the at least one first side conductive line member is embedded in the cover member such that one end part of the first side conductive line member is electrically connected to the controller, and the other end part of the first side conductive line member is adapted to be electrically connected to the external device; and each of the at least one second side conductive line member is embedded in the cover member such that one end part of the second side conductive line member is electrically connected to the controller, and the other end part of the second side conductive line member is electrically connected to the electric fuel pump.

5. The fuel supply apparatus according to claim 1, wherein a bonding agent layer, which is made of a silicone bonding agent, is placed between the controller and the inner wall surface of the receiving portion to join therebetween.

6. A fuel supply apparatus that is adapted to supply fuel, which is received in a fuel tank, to a fuel consuming apparatus located at an outside of the fuel tank, the fuel supply apparatus comprising:

a cover member that covers a hole formed in the fuel tank, wherein the cover member is integrally molded from a resin material and the cover member includes an inner-tank side and an outer-tank side opposed to one another;

an electric fuel pump that is placed in an inside of the fuel tank, wherein the electric fuel pump draws the fuel received in the fuel tank and discharges the drawn fuel upon pressurizing the drawn fuel when an electric power is supplied to the electric fuel pump;

a controller that is installed to the cover member and includes at least one first side terminal, which is adapted to be electrically connected to an external device located at the outside of the fuel tank, and at least one second side terminal, which is electrically connected to the electric fuel pump, wherein the controller receives a command signal from the external device through a corresponding one of the at least one first side terminal and supplies the electric power to the electric fuel pump through the at least one second side terminal based on the command signal received from the external device;

at least one first side conductive line member, each of which is made of an electrically conductive metal material and is embedded in the cover member such that one end part of the first side conductive line member is electrically connected to a corresponding one of the at least one first side terminal, and the other end part of the first side conductive line member is exposed from the cover member and is adapted to be electrically connected to the external device;

at least one second side conductive line member, each of which is made of an electrically conductive metal material and is embedded in the cover member such that one end part of the second side conductive line member is electrically connected to a corresponding one of the at least one second side terminal, and the other end part of the second side conductive line member is exposed from the cover member and is electrically connected to the electric fuel pump; and a protective member that is embedded in the cover member such that at least a portion of the protective member is surrounded by the cover member on the inner-tank side and the outer-tank side and the protective member is made of a resin material, which has a thermal expansion coefficient that is smaller than a thermal expansion coefficient of the resin material of the cover member, wherein:

a portion of the protective member surrounds and directly covers each connecting portion between the corresponding one of the at least one first side terminal and the corresponding one of the at least one first side conductive line member and each connecting portion between the corresponding one of the at least one second side terminal and the corresponding one of the at least one second side conductive line member; and the portion of the protective member, which surrounds and directly covers each connecting portion between the corresponding one of the at least one first side terminal and the corresponding one of the at least one first side conductive line member and each connecting portion between the corresponding one of the at least one second side terminal and the corresponding one of the at least one second side conductive line member, is entirely embedded in the cover member.

7. The fuel supply apparatus according to claim 6, wherein a swelling ratio of a volume of the resin material of the protective member, which is measurable upon immersion of the resin material of the protective member into the fuel, is smaller than that of the resin material of the cover member.

8. The fuel supply apparatus according to claim 6, wherein the protective member includes at least one anchor portion, each of which is embedded in the cover member and has:

a first projecting part that projects from a surface of the protective member; and a second projecting part that projects from the first projecting part generally in parallel to the surface of the protective member such that a gap is formed between the surface of the protective member and the second projecting part.

9. The fuel supply apparatus according to claim 8, wherein:

a size of the cover member, which is measured in a direction generally perpendicular to an axis of the hole of the fuel tank, is larger than a size of the cover member, which is measured in a direction generally parallel to the axis of the hole of the fuel tank; and the at least one anchor portion is formed in the surface of the protective member that is directed in a corresponding direction, which is generally perpendicular to the axis of the hole of the fuel tank.

10. The fuel supply apparatus according to claim 6, wherein:

the resin material of the cover member is polyacetal; and the resin material of the protective member is one of polyphenylene sulfide and polyphthalamide.

11. The fuel supply apparatus according to claim 6, wherein another portion of the protective member is held between the controller and the cover member on a side of the controller where the inside of the fuel tank is located.

12. A fuel supply apparatus that is adapted to supply fuel, which is received in a fuel tank, to a fuel consuming apparatus located at an outside of the fuel tank based on a signal received from an external device, the fuel supply apparatus comprising:

an electric fuel pump that is placed in an inside of the fuel tank, wherein the electric fuel pump draws the fuel received in the fuel tank and discharges the drawn fuel upon pressurizing the drawn fuel when an electric power is supplied to the electric fuel pump;

a control device that includes a controller, which controls the electric fuel pump based on the signal received from the external device;

a plurality of conductive line members, each of which projects from the control device and electrically connects between the controller and a corresponding one of the external device and the electric fuel pump; and a cover member that is made of a resin material and covers a hole formed in the fuel tank, wherein the control device and the plurality of conductive line members are embedded in and are held by the cover member such that at least a portion of the control device and at least a portion of each of the plurality of conductive line members are exposed from the cover member, wherein:

an expansion coefficient of a holding portion of the control device, which contacts the cover member and is held by the cover member, is different from an expansion coefficient of the cover member;

the holding portion is made of a resin material;

the expansion coefficient of the resin material of the holding portion is smaller than the expansion coefficient of the resin material of the cover member; and a primer agent is applied to a root part of each of the plurality of conductive line members, which is located adjacent to the control device, wherein the primer agent surrounds the root part and contacts the holding portion of the control device and the cover member.

13. The fuel supply apparatus according to claim 12, wherein the primer agent is a bonding agent.

14. The fuel supply apparatus according to claim 13, wherein the primer agent includes epichlorohydrin rubber.

15. The fuel supply apparatus according to claim 12, wherein:

the cover member is made of a resin material that has a melting temperature lower than that of the holding portion of the control device; and the control device is embedded in the cover member by insert molding and is held by the cover member.

16. The fuel supply apparatus according to claim 12, wherein:

the expansion coefficient of the holding portion of the control device is a thermal expansion coefficient of the holding portion; and the expansion coefficient of the cover member is a thermal expansion coefficient of the cover member.

17. The fuel supply apparatus according to claim 12, wherein:

the expansion coefficient of the holding portion of the control device is a swelling coefficient of the holding portion with respect to swelling of the holding portion induced by impregnation of the fuel into the holding portion; and the expansion coefficient of the cover member is a swelling coefficient of the cover member with respect to swelling of the cover member induced by impregnation of the fuel into the cover member.

* * * * *